US007093370B2

(12) United States Patent
Hansberry et al.

(10) Patent No.: US 7,093,370 B2
(45) **Date of Patent: *Aug. 22, 2006**

(54) MULTI-GIMBALED BOREHOLE NAVIGATION SYSTEM

(75) Inventors: Mitchell L. Hansberry, Southborough, MA (US); Michael E. Ash, Lexington, MA (US); Richard T. Martorana, Andover, MA (US)

(73) Assignee: The Charles Stark Draper Laboratory, Inc., Cambridge, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/987,117

(22) Filed: Nov. 12, 2004

(65) Prior Publication Data

US 2005/0126022 A1 Jun. 16, 2005

Related U.S. Application Data

(63) Continuation-in-part of application No. 10/632,717, filed on Aug. 1, 2003, now Pat. No. 6,895,678.

(51) Int. Cl.
*G01C 19/00* (2006.01)

(52) U.S. Cl. ..... 33/313; 33/321; 33/366.13

(58) Field of Classification Search ..... 33/313, 33/304, 318, 321, 322, 323, 328, 366.11, 33/366.12, 366.13, 542, 544
See application file for complete search history.

(56) References Cited

U.S. PATENT DOCUMENTS

| | | | |
|---|---|---|---|
| 3,079,696 | A | 3/1963 | van Rooyen |
| 3,883,788 | A | 5/1975 | Storey, Jr. |
| 4,052,654 | A | 10/1977 | Kramer et al. |
| 4,071,959 | A | 2/1978 | Russell et al. |
| 4,454,756 | A | 6/1984 | Sharp et al. |
| 4,537,067 | A | 8/1985 | Sharp et al. |
| 4,594,790 | A | 6/1986 | Engebretson |
| 4,696,112 | A | 9/1987 | Hoffman |
| 4,756,088 | A | 7/1988 | Russell et al. |
| 4,987,684 | A | 1/1991 | Andreas et al. |
| 5,126,812 | A | 6/1992 | Greiff |
| 5,156,056 | A | 10/1992 | Pittman et al. |
| 5,349,855 | A | 9/1994 | Bernstein et al. |

(Continued)

FOREIGN PATENT DOCUMENTS

WO WO 03/031912 A2 4/2003

OTHER PUBLICATIONS

U.S. Appl. No. 10/768,309, filed Jan. 30, 2004, Ash et al.

(Continued)

*Primary Examiner*—Christopher W. Fulton
(74) *Attorney, Agent, or Firm*—Iandiorio & Teska

(57) ABSTRACT

An omnidirectional borehole navigation system is provided that includes a housing that can be placed within the smaller diameter drill pipes used towards the bottom of a borehole, an outer gimbal connected to the housing, and at least two or more stacked inner gimbals that are nested in and connected to the outer gimbal, the inner gimbals each having an axis parallel to one another and perpendicular to the outer gimbal. The inner gimbals contain electronic circuits, gyros whose input axes span three dimensional space, and accelerometers whose input axes span three dimensional space. There are an outer gimbal drive system, an inner gimbal drive system for maintaining the gyro input axes and the accelerometer input axes as substantially orthogonal triads, and a processor responsive to the gyro circuits and the accelerometer circuits to determine the attitude and the position of the housing in the borehole.

44 Claims, 16 Drawing Sheets

U.S. PATENT DOCUMENTS

| | | | | |
|---|---|---|---|---|
| 5,396,326 | A | 3/1995 | Knobbe et al. | |
| 5,432,699 | A | 7/1995 | Hache et al. | |
| 5,657,547 | A | 8/1997 | Uttecht et al. | |
| 5,806,195 | A | 9/1998 | Uttecht et al. | |
| 6,216,804 | B1 | 4/2001 | Aumann et al. | |
| 6,267,185 | B1 | 7/2001 | Mougel et al. | |
| 6,347,282 | B1 | 2/2002 | Estes et al. | |
| 6,548,321 | B1 | 4/2003 | Sawyer | |
| 6,778,908 | B1 | 8/2004 | Ash et al. | |
| 6,895,678 | B1 * | 5/2005 | Ash et al. | 33/313 |
| 6,918,186 | B1 * | 7/2005 | Ash et al. | 33/313 |

OTHER PUBLICATIONS

U.S. Appl. No. 10/632,717, filed Aug. 1, 2003, Ash et al.

* cited by examiner

Accel Board Assembly

Gyro Board Assembly

DEAD RECKONING FOR KINEMATIC NAVIGATION WHILE DRILLING BETWEEN GYROCOMPASSES

KINEMATIC NAVIGATION WHILE DRILLING

INERTIAL NAVIGATION WHILE DRILLING OR LOGGING

MULTI-GIMBALED BOREHOLE NAVIGATION SYSTEM

RELATED APPLICATION

This application is a continuation-in-part of U.S. patent application Ser. No. 10/632,717, filed on Aug. 1, 2003 entitled "BOREHOLE NAVIGATION SYSTEM", now issued as U.S. Pat. No. 6,895,678, issued on May 24, 2005, which is herein incorporated by reference.

FIELD OF THE INVENTION

This invention relates to a navigation system for traversing a borehole. More specifically, the invention relates to a borehole navigation system that can determine position and attitude for any orientation in a borehole utilizing multiple gimbals containing solid state or other gyros and accelerometers that fit within the small diameter of the borehole drill pipe.

BACKGROUND OF THE INVENTION

For several reasons, it is essential to accurately monitor and guide the direction of the drill bit such that a borehole is created where desired. One reason is that it is expensive to drill a borehole at a cost of about $500,000 per day. Another reason is that it may be necessary by law for an oil rig to log the location of its boreholes at a regular frequency such that the oil rig can be properly monitored.

Many prior art systems have attempted to accurately and efficiently monitor the location of the drill bit to determine its location, but each system has had limitations. For example, the internal diameter of a drill pipe may not be large enough to fit the optimal number of typical navigation sensors. To overcome this obstacle, one prior art system removes the drill bit from the borehole and lowers a monitoring tool down the borehole to determine its current location. A disadvantage of this system is that it is costly to stop drilling and spend time removing the drill bit to take measurements with the monitoring tool.

To determine the location of a drill bit in a borehole, it is desirable to know the position and the attitude, which includes the vertical orientation and the north direction. To know the position, it is first desirable to know the attitude. Typically, gyroscopes can be used to determine the north direction, and accelerometers can be used to determine the vertical orientation. Prior art systems have used single orientation gyroscopes and/or single orientation accelerometers due to size limitations. However, these systems can suffer from long-term bias stability problems.

In another prior art system, single-axis accelerometers are used to determine the vertical orientation of the drill bit. A system such as this, however, does not provide the drill bit's orientation relative to north, which is necessary to determine the full location of a borehole: a system that uses accelerometers is typically only adequate if the oil rig is going to drill a vertical borehole, since an accelerometer system cannot determine north.

In other prior art systems, a magnetometer is used to determine the magnetic field direction from which the direction of north is approximated. However, systems such as these must make corrections for magnetic interference and use of magnetic materials for the drill pipe. Additionally, systems that rely only on magnetometers to determine north can suffer accuracy degradation due to the Earth's changing magnetic field.

The use of gimbals in a navigation system is desirable to calibrate the sensors and to compensate for the sensor biases such that the system can accurately determine attitude and position. A navigation system using gimbals may be more accurate by a factor of 100 compared to a non-gimbaled strapdown system. Moreover, a navigation system that uses two or more gimbals only requires the sensors to be stable for a few minutes, rather than for days, in comparison to a system that doesn't use gimbals.

One prior art system uses only a single gimbal for all sensors. However, this system does not allow simultaneous estimation of all sensor biases nor the estimation of the north and the vertical for all borehole orientations. Other systems have used gimbals within a gyro sensor, but this does not provide all axes of observability.

BRIEF SUMMARY OF THE INVENTION

It is therefore an object of this invention to provide a borehole navigation system with two or more gimbals that is the same or smaller in diameter than prior borehole navigation systems without gimbals or with a single gimbal.

It is a further object of this invention to provide such a borehole navigation system that can be placed within a drill pipe, in particular for the smaller diameter drill pipes used towards the bottom of a borehole.

It is a further object of this invention to provide such a borehole navigation system that can determine position and attitude for any orientation of the borehole navigation system.

It is a further object of this invention to provide such a borehole navigation system that can average out the navigation errors due to gyro and accelerometer bias errors and average out the navigation errors due to gyro scale factor and input axis alignment errors during navigation of the borehole navigation system.

It is a further object of this invention to provide such a borehole navigation system that allows gyro and accelerometer bias calibration and gyro scale-factor calibration as well as attitude determination during gyrocompassing.

It is a further object of this invention to provide such a borehole navigation system that has long-term performance accuracy with only short term requirements on sensor accuracy.

It is a further object of this invention to provide such a borehole navigation system that can determine position and attitude while drilling, when the drill bit is stopped, or when the drill bit is inserted or withdrawn.

It is a further object of this invention to provide such a borehole navigation system that can determine position and attitude while logging, both descending and ascending on a log line after the drill bit has been withdrawn.

It is a further object of this invention to provide an even smaller diameter borehole navigation system that uses stacked inner gimbals.

It is a further object of this invention to provide such a borehole navigation system that can effectively control the orientation of the stacked inner gimbals.

The invention results from the realization that a smaller and more accurate omnidirectional borehole navigation system can be achieved by using a gimbal system that includes at least one outer gimbal connected to a housing, and two or more stacked inner gimbals connected to the outer gimbal, a drive system for controlling the orientation of the stacked inner gimbals, three or more gyro assemblies and three or more accelerometer assemblies, and a microprocessor responsive to gyro circuits and accelerometer circuits for determining the attitude and position of the housing in its borehole.

This invention features an omnidirectional borehole navigation system including a housing for traversing a borehole; an outer gimbal connected to the housing and at least two stacked inner gimbals that are connected to the outer gimbal, the inner gimbals each having an axis parallel to one another and perpendicular to an axis of the outer gimbal; at least one inertial sensor located on each inner gimbal, the at least one inertial sensor selected from at least one gyro and at least one accelerometer, the gyros having input axes that span three dimensional space, and the accelerometers having input axes that span three dimensional space; one or more gyro circuits within the housing and responsive to the at least one gyro to produce the inertial angular rate about each gyro input axis; one or more accelerometer circuits within the housing and responsive to the at least one accelerometer to produce the non-gravitational acceleration along each accelerometer input axis; a processor responsive to the gyro circuits and the accelerometer circuits for determining the attitude and the position of the housing in the borehole; an outer gimbal drive system for controlling the orientation of the outer gimbal; and an inner gimbal drive system for controlling the orientation of each of the inner gimbals.

In one embodiment the outer gimbal may have complete rotary freedom. The inner gimbal drive system may include an inner gimbal drive motor, a rotary-to-linear gear connected to the drive motor, a rack connected to the rotary-to-linear gear and a plurality of pinions each engaging the rack, each pinion connected to an inner gimbal for maintaining the gyro input axes at substantially an orthogonal triad and the accelerometer input axes at substantially an orthogonal triad. The inner gimbal drive system may also include a drive motor, a gear train driven by the drive motor, each of the inner gimbals connected to the drive motor through the gear train for maintaining the gyro input axes at substantially an orthogonal triad and the accelerometer input axes at substantially an orthogonal triad. The gear train may include a bicycle chain gear. The rack may include stops that are elastic to compensate for misalignments between the rack and the pinions. There may be six stacked inner gimbals each having one inertial sensor located thereon. There may be five stacked inner gimbals, two of which each include a two-degree-of-freedom gyro and the other three each including an accelerometer. The borehole navigation system may also have three stacked inner gimbals, two of which each include a two-degree-of-freedom gyro and one includes three accelerometers. There may also be three stacked inner gimbals each having two inertial sensors located thereon. There may be two stacked inner gimbals each having three inertial sensors located thereon. There may be three gyros each having an input axis, the gyro input axes substantially forming an orthogonal triad. There may be three accelerometers, each having an input axis, the three input axes substantially forming an orthogonal triad. The gyros may be MEMS gyros and the accelerometers may be MEMS accelerometers. The borehole navigation system may have three inner gimbals each having one MEMS gyro and one MEMS accelerometer located therein, the gyro input axes substantially forming an orthogonal triad and the accelerometer input axes substantially forming an orthogonal triad at each inner gimbal position. The borehole navigation system outer gimbal may have complete rotary freedom. The inner gimbals may have complete rotary freedom. The inner gimbals may have rotary freedom between their respective stops. The borehole navigation system may further include a plurality of drive motors, one drive motor connected to each of the inner gimbals and one to the outer gimbal. The borehole navigation system may include a plurality of latching mechanisms connected to the rack for keeping each pinion at its respective stop. Each inner gimbal may include a gimbal angle readout. The inner gimbal angle readout may be connected to the inner gimbal drive motor. The inner gimbals may be electrically coupled to the outer gimbal by a coupling selected from twist wires, twist capsules, slip rings and rotary transformers. The inner gimbals may be configured to communicate with the outer gimbal by a link selected from an optical communications link, an electrostatic communications link, slip rings, rotary transformers, twist wires, and twist capsules. The outer gimbal may be electrically coupled externally by a coupling selected from slip rings and rotary transformers. The outer gimbal may be configured to communicate externally by a communications link selected from an optical communications link, an electrostatic communications link, a rotary transformer and slip rings. The gyros and accelerometers may each be oriented, respectively, in an orthogonal triad configuration.

This invention also features an omnidirectional borehole navigation system including a housing for traversing a borehole; at least one outer gimbal connected to the housing and at least two stacked inner gimbals that are nested in and connected to the outer gimbal, the inner gimbals each having an axis parallel to one another and perpendicular to an axis of the outer gimbal; at least one inertial sensor located on each inner gimbal, the at least one inertial sensor including at least one gyro or accelerometer, the gyros having input axes that span three dimensional space and the accelerometers having input axes that span three dimensional space; an outer gimbal drive system; an inner gimbal drive system including an inner gimbal drive motor, a rotary-to-linear gear connected to the inner gimbal drive motor, a rack connected to the rotary-to-linear gear and a plurality of pinions each engaging the rack, each pinion connected to an inner gimbal for maintaining the gyro input axes at substantially an orthogonal triad and the accelerometer input axes at substantially an orthogonal triad; one or more gyro circuits within the housing and responsive to the at least one gyro to produce the inertial angular rate about each gyro input axis; one or more accelerometer circuits within the housing and responsive to the at least one accelerometer to produce the non-gravitational acceleration along each accelerometer input axis; and a processor responsive to the gyro logic circuits and the accelerometer logic circuits for determining the attitude and the position of the housing in its borehole.

In one embodiment, the rack may include inner gimbal stops that are elastic to compensate for small misalignments between the pinions and the rack. The borehole navigation system may have six stacked inner gimbals each having one inertial sensor located thereon. There may be five stacked inner gimbals, two of which each include a two-degree-of-freedom gyro and the other three each including an accelerometer. There may be three stacked inner gimbals, two of which each include a two-degree-of-freedom gyro and one having a triad of accelerometers. There may be three inner gimbals each having two inertial sensors located thereon. There may be two inner gimbals each having three inertial sensors located thereon. The borehole navigation system may also have three gyros each having an input axis, the three input axes substantially forming an orthogonal triad. The borehole navigation system may further include three accelerometers, each having an input axis, the three input axes substantially forming an orthogonal triad. The gyros may be MEMS gyros and the accelerometers may be MEMS accelerometers. The three inner gimbals may each have one MEMS gyro and one MEMS accelerometer located therein, the gyro input axes substantially forming an orthogonal triad and the accelerometer input axes substantially forming an orthogonal triad at each inner gimbal position.

This invention further features an omnidirectional borehole navigation system including a housing for traversing a borehole; an outer gimbal connected to the housing and at least two stacked inner gimbals that are connected to the outer gimbal, the inner gimbals each having an axis parallel to one another and perpendicular to an axis of the outer gimbal; at least one inertial sensor located on each inner gimbal, the at least one inertial sensor selected from at least one gyro and at least one accelerometer, the gyros having input axes that span three dimensional space and the accelerometers having input axes that span three dimensional space, the borehole navigation system determining the attitude and the position of the housing in the borehole.

In one embodiment, the omnidirectional borehole navigation system may further include one or more gyro circuits within the housing and responsive to the at least one gyro to produce the inertial angular rate about each gyro input axis. The omnidirectional borehole navigation system may further include one or more accelerometer circuits within the housing and responsive to the at least one accelerometer to produce the non-gravitational acceleration along each accelerometer input axis. The omnidirectional borehole navigation system may further include a processor responsive to the gyro circuits and the accelerometer circuits for determining the attitude and the position of the housing in the borehole. The omnidirectional borehole navigation system may further include a drive system for controlling the orientation of each of the inner gimbals. The omnidirectional borehole navigation system may further include a drive system for controlling the orientation of the outer gimbal.

This invention further features an omnidirectional borehole navigation system including a housing for traversing a borehole; at least one outer gimbal connected to the housing and three stacked inner gimbals that are nested in and connected to the outer gimbal, the inner gimbals each having an axis parallel to one another and perpendicular to an axis of the outer gimbal; one MEMS gyro and one MEMS accelerometer located in each inner gimbal, the gyros having input axes substantially forming an orthogonal triad and the accelerometers having input axes substantially forming an orthogonal triad at each position of the inner gimbals; an outer gimbal drive system coupled to the at least one outer gimbal; an inner gimbal drive system including an inner gimbal drive motor, a rotary-to-linear gear connected to the inner gimbal drive motor, a rack connected to the rotary-to-linear gear and a plurality of pinions each engaging the rack, each pinion connected to an inner gimbal for maintaining the gyro input axes at substantially an orthogonal triad and the accelerometer input axes at substantially an orthogonal triad at each gimbal position; one or more gyro circuits within the housing and responsive to the at least one gyro to produce the inertial angular rate about each gyro input axis; one or more accelerometer circuits within the housing and responsive to the at least one accelerometer to produce the non-gravitational acceleration along each accelerometer input axis; and a processor responsive to the gyro logic circuits and the accelerometer logic circuits for determining the attitude and the position of the housing in its borehole.

BRIEF DESCRIPTION OF THE DRAWINGS

Other objects, features and advantages will occur to those skilled in the art from the following description of a preferred embodiment and the accompanying drawings, in which.

DISCLOSURE OF THE PREFERRED EMBODIMENT

Figure 1:
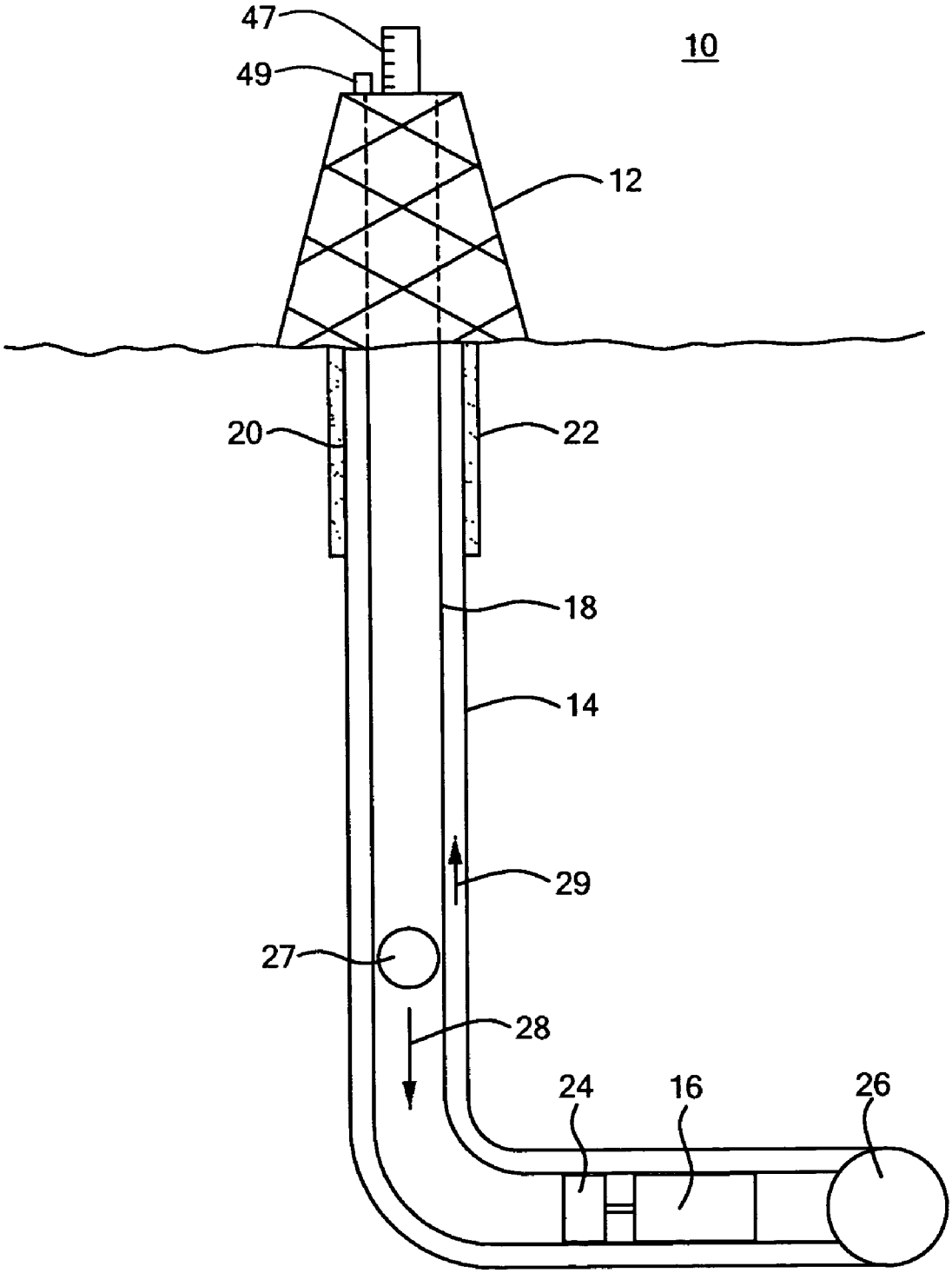
FIG. 1 is a cross-sectional schematic diagram of a drilling system that includes a borehole navigation system in a drill pipe.

Aside from the preferred embodiment or embodiments disclosed below, this invention is capable of other embodiments and of being practiced or being carried out in various ways. Thus, it is to be understood that the invention is not limited in its application to the details of construction and the arrangements of components set forth in the following description or illustrated in the drawings.

There is shown in FIG. 1 a drilling system 10 that includes drilling rig 12 in borehole 14, and borehole mitigated navigation system 16. Drilling rig 12 may be located on top of an ocean surface or on a land surface. Borehole 14 includes one or more connected drill pipes 18 that are surrounded by steel casing 20 and cement liner 22. Navigation system 16 includes DC power generator 24 and is adjacent to drill bit 26. While drilling, the mud flows to drive the drill bit, and also drives DC power generator 24. Mud 27 is flowed down the inside of the drill pipe in the direction of arrow 28, and returns up the outside of the drill pipe in the direction of arrow 29 carrying away drill cuttings. DC power generator 24 provides electrical power to navigation system 16, and charges the battery used when mud is not flowing. The flow of mud stops when drilling is stopped to add a length of drill pipe. Navigation system 16 is configured to determine the vertical orientation and azimuth relative to north of navigation system 16 when drilling is stopped, and to navigate while drilling, such that it can provide the location for drill bit 26, which is located adjacent to navigation system 16. The navigation system may also include a temperature control system (not shown) as disclosed in U.S. Pat. No. 6,778,908, issued Aug. 17, 2004, entitled "Environmentally Mitigated Navigation System", which is incorporated herein by reference. Periodically, the drill string is withdrawn from the borehole and the hole lined with steel and concrete casing up to the point where drilling was stopped, and then drilling recommences with a smaller diameter drill bit beyond the casing. Thus the diameter of the borehole gets progressively smaller towards its bottom, thus making it desirable that the navigation system behind the drill head have a small diameter.

Figure 2:
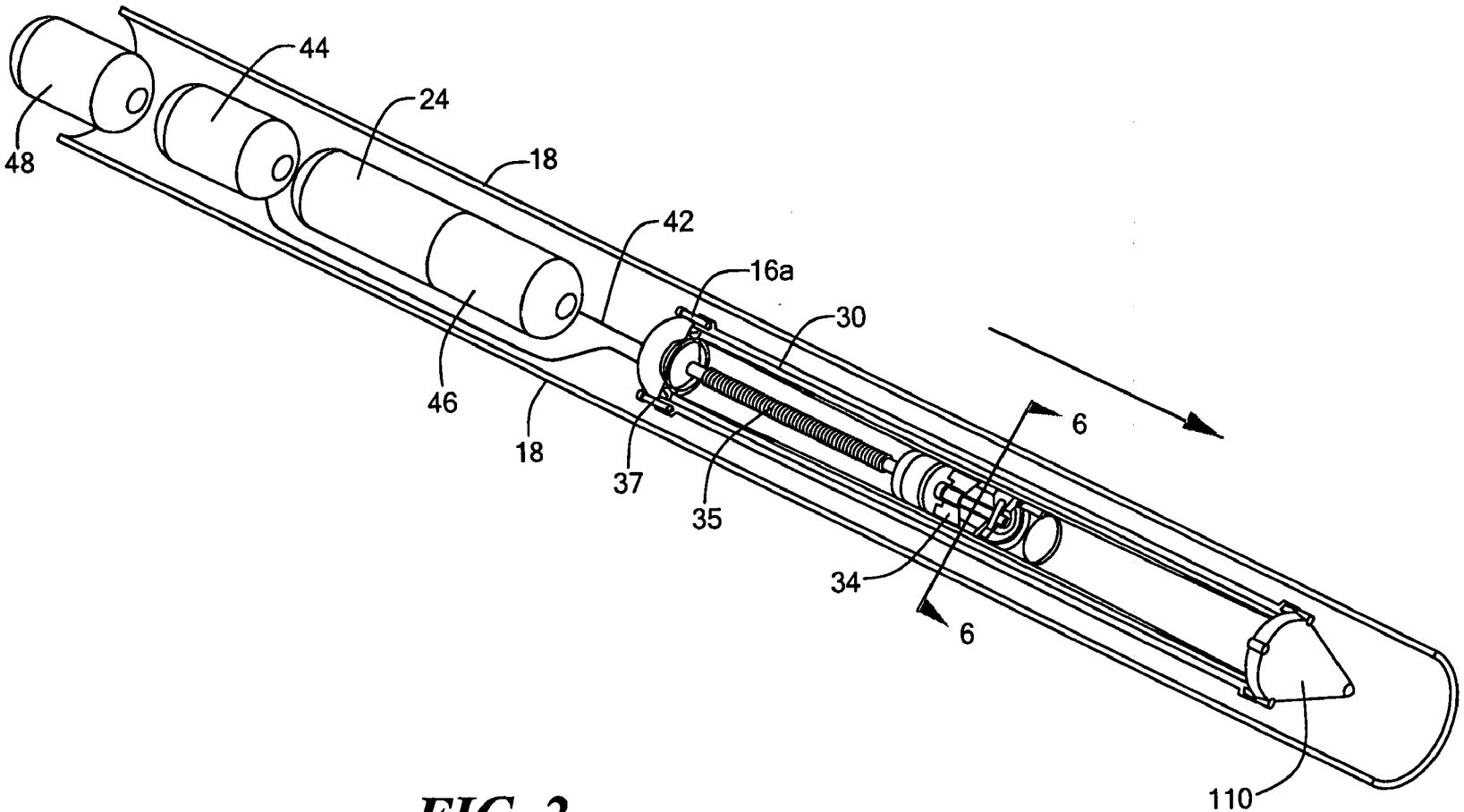
FIG. 2 is a more detailed cross-sectional schematic diagram of the borehole navigation system in a drill pipe shown in FIG. 1.

Navigation system 16*a*, FIG. 2, includes a housing 30 such as a pressure vessel, a gimbal system 34, a flexible heat pipe 35, thermoelectric coolers 37, and an end cap 110. Navigation system 16*a* may also include a mud pulse data communicator 44 and a ΔL device 45 for obtaining and transmitting the incremental distance advance of drill pipe in the borehole. Mud pulse data communicator 44 is coupled to navigator housing 30 through wire 46 and communicates navigation related information to an external device, such as a drilling rig, through drill pipe 18. ΔL device 45 communicates to navigation system 16*a* information relating to the incremental change in distance that navigation system 16*a* has traveled. Flexible heat pipe 35 conducts heat from gimbal system 34 to thermoelectric coolers 37.

ΔL device 45 can obtain information about the incremental distance advanced through any of a number of different methods. For example, each section of drill pipe can contain hash marks 47, FIG. 1, that are read by scanning device 49 on the surface to determine how far each drill pipe has traversed down a borehole. ΔL information can then be transmitted to navigation system 16*a* through data communicator 44.

Figure 3:
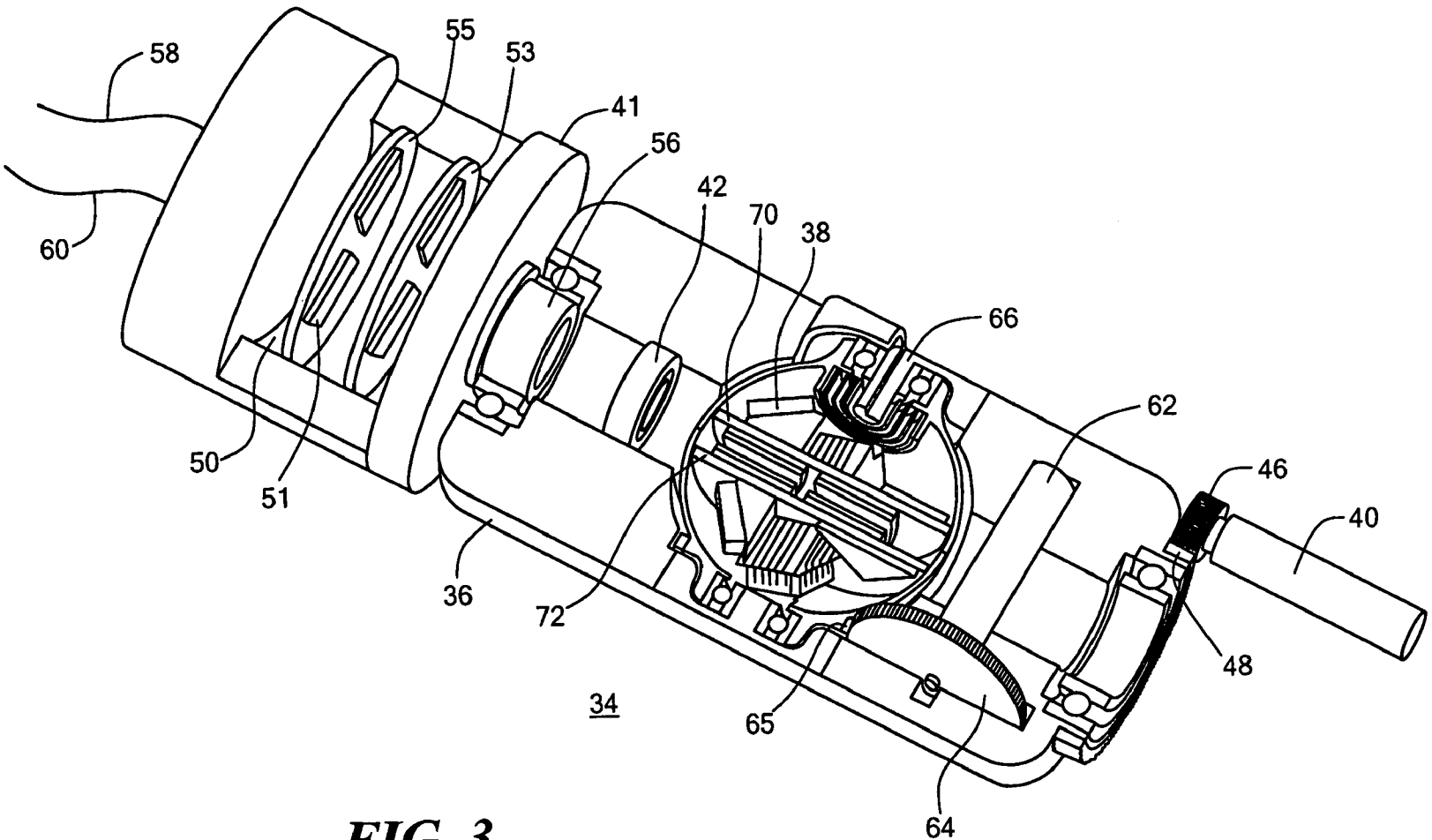
FIG. 3 is an enlarged, more detailed, cross-sectional schematic diagram of the gimbal assembly shown in FIG. 2.

Gimbal system 34, FIG. 3, includes outer gimbal 36 and inner gimbal 38. Outer gimbal 36 rotates about an axis longitudinally to the drill pipe. At one end, outer gimbal 36 is driven by outer gimbal motor 40, and at another end is supported by outer gimbal support 41. Outer gimbal 36 is driven by an outer gimbal motor 40 that drives motor gear 46, which drives gimbal gear 48 to rotate outer gimbal 36, or outer gimbal motor 40 could be a direct drive motor. Outer gimbal 36 also includes a resolver or other gimbal angle readout and a slip ring 42 to transmit electrical signals to outside the outer gimbal.

Outer gimbal support 41 includes a cavity 50 that encloses a temperature controller printed circuit board 53 and a motor controller printed circuit board 55. Board 55 includes a processor 51. Electrical signals from outer gimbal 36 are transmitted through slip rings 42 to boards 53 and 55 through an opening 56 in outer gimbal support 41. Outer gimbal support 41 includes wires 58 and 60 to transmit electrical signals to and from DC power generator 24, FIG. 2, and mud pulse data communicator 44. Alternatively, rather than using slip ring 42, outer gimbal 36 could include a rotary transformer or other means for transmitting signals with complete rotary freedom.

Inner gimbal 38, FIG. 3, includes an inner gimbal motor 62 that drives gear 64, which drives inner gimbal gear 65. Inner gimbal 38 includes twist capsule 66 for transmitting electrical signals from within the inner gimbal to outer gimbal 36 and may include a resolver or other gimbal angle readout. Twist capsule 66 is not necessary to the invention and could be replaced by a slip ring, a rotary transformer, or other rotary signal transfer device.

Figure 4:
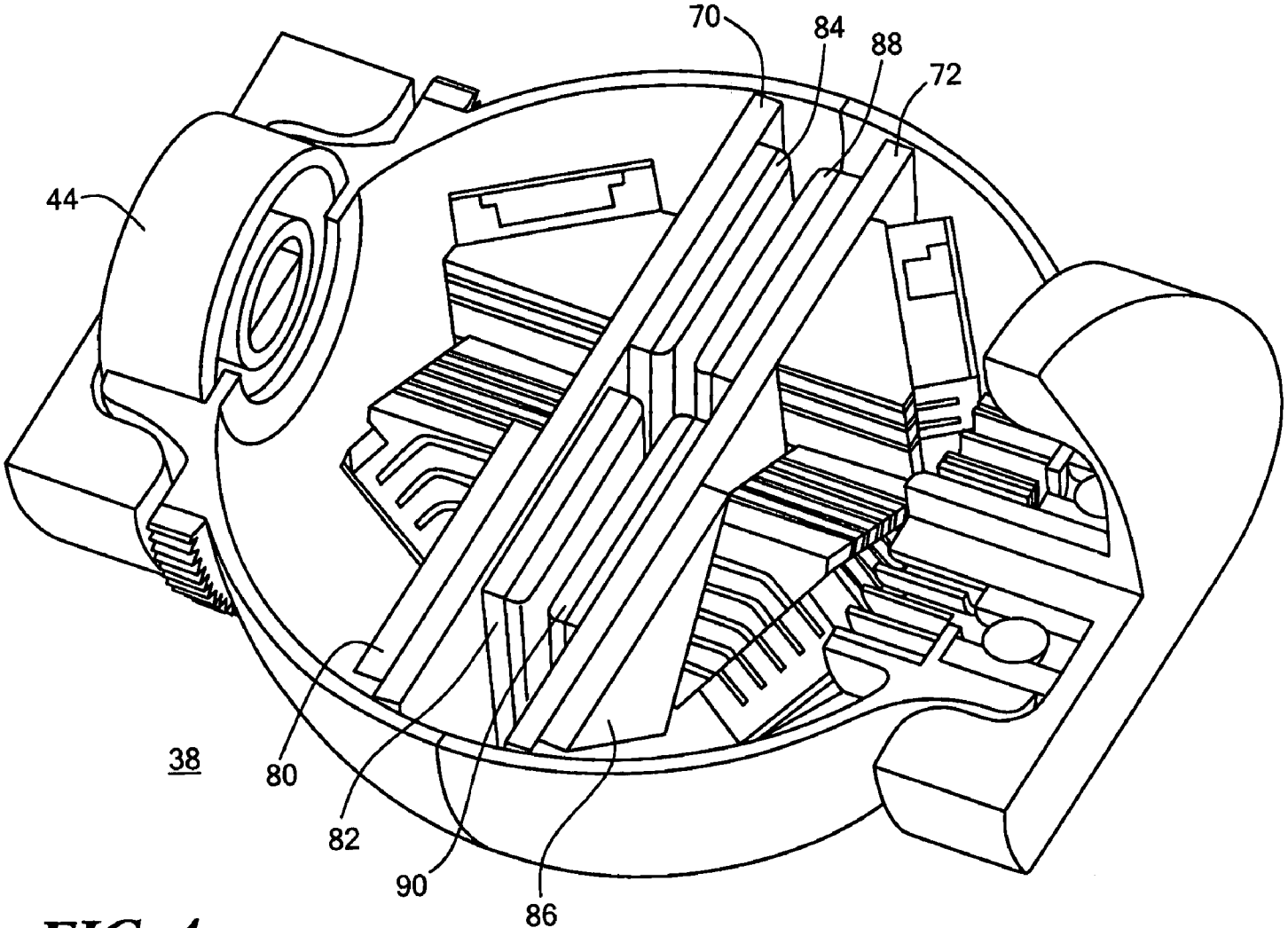
FIG. 4 is an enlarged, more detailed, cross-sectional schematic diagram of the inner gimbal shown in FIG. 3.
Figure 5A:
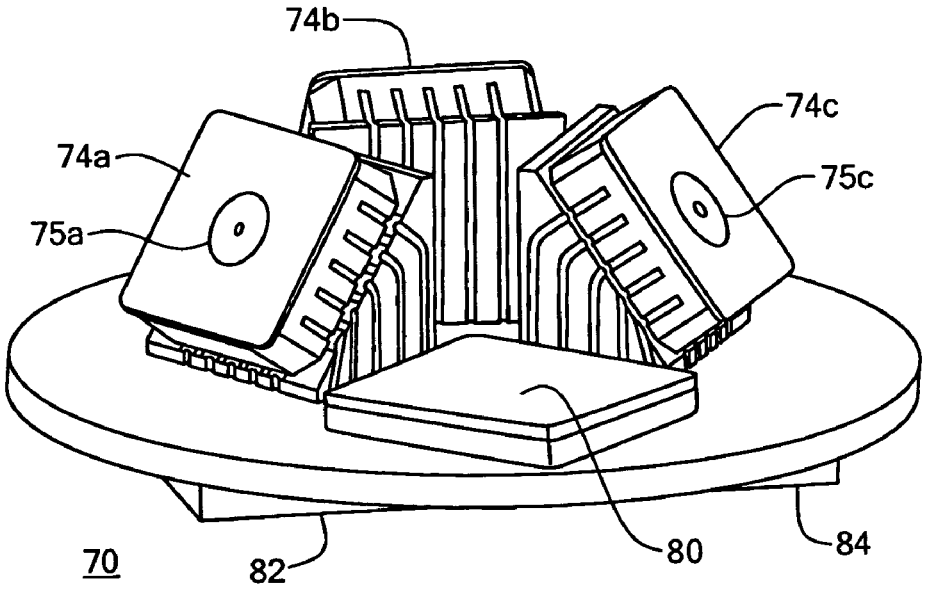
FIG. 5A is a more detailed schematic diagram of the accelerometer board assembly of FIG. 4.
Figure 5B:
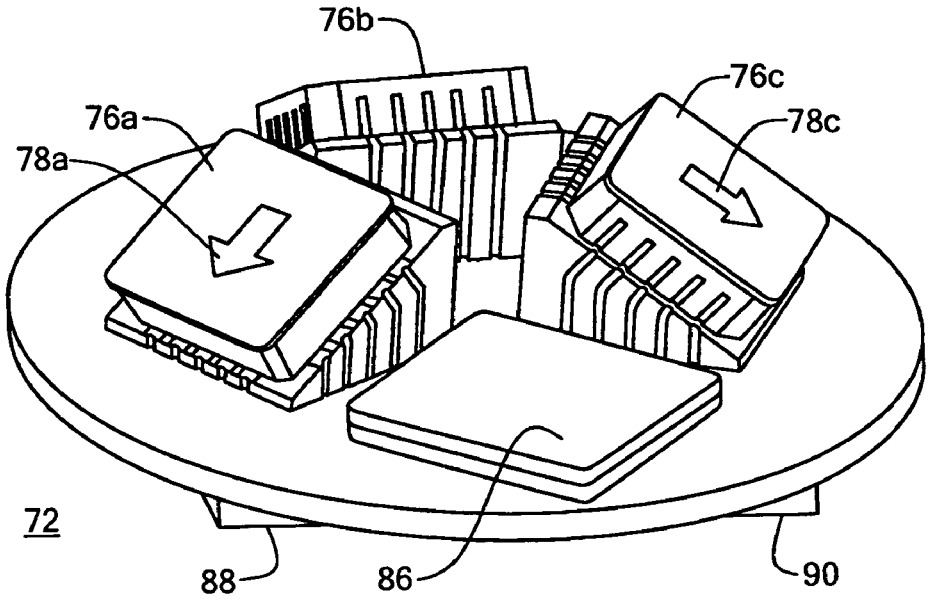
FIG. 5B is a more detailed schematic diagram of the gyro board assembly of FIG. 4.

Inner gimbal 38 includes an accelerometer board assembly 70, FIGS. 4 and 5A, and a gyro board assembly 72, FIGS. 4 and 5B. Accelerometer board assembly 70 includes three accelerometers 74*a*, 74*b*, and 74*c* that are each oriented orthogonally to each other as indicated in part by markings 75*a* and 75*c* in which like parts have been given like numbers each accompanied by a lower-case letter. Gyroscope board assembly 72 includes three gyroscopes 76*a*, 76*b*, and 76*c* that are also oriented orthogonally to each other as indicated in part by lines 78*a* and 78*c*. Accelerometers 74*a*, 74*b*, and 74*c* and gyros 76*a*, 76*b*, and 76*c* may be MEMS sensors, such as those described in U.S. Pat. Nos. 5,126,812, 5,349,855 and 6,548,321, and PCT published application WO 03/031912 A2, all assigned to Draper Laboratory in Cambridge, Mass., or may be laser or quartz sensors.

Accelerometer board assembly 70 includes logic circuits such as a field programmable gate array (FPGA) 80 and application-specific integrated circuits (ASICs) 82 and 84. Gyroscope board assembly 72 also includes logic circuits such as field programmable gate array 86 and application-specific integrated circuits 88 and 90.

Figure 6:
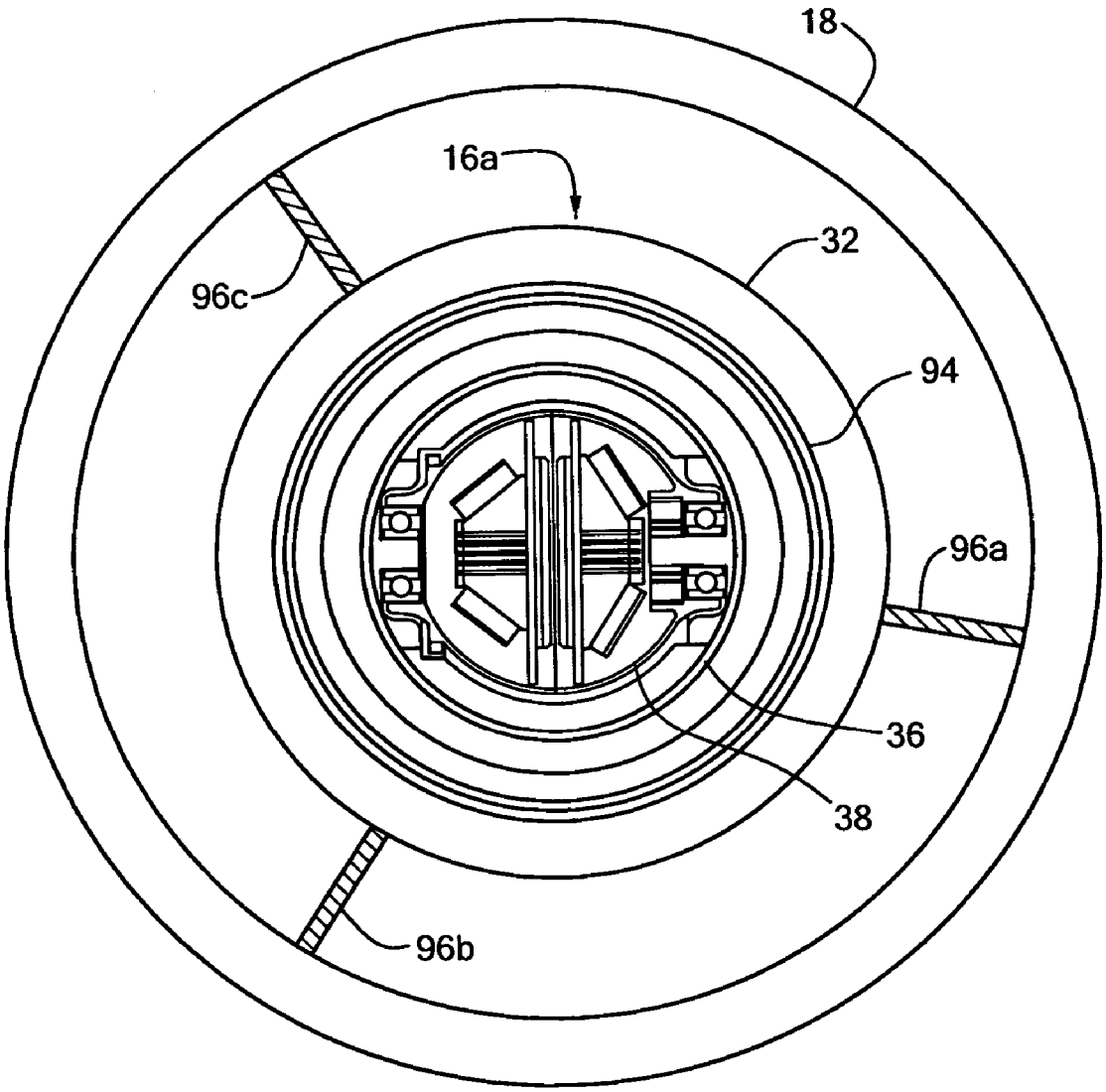
FIG. 6 is a cross-sectional schematic diagram of the borehole navigation system of FIG. 2 taken along the line 6—6 shown in FIG. 2.

Navigation system 16*a* includes a double-walled Dewar 94, FIG. 6, within housing 32 for providing thermal isolation. Navigation system 16*a* can be spaced from drill pipe 18 by one or more supports 96*a*–96*c*.

Figure 7:
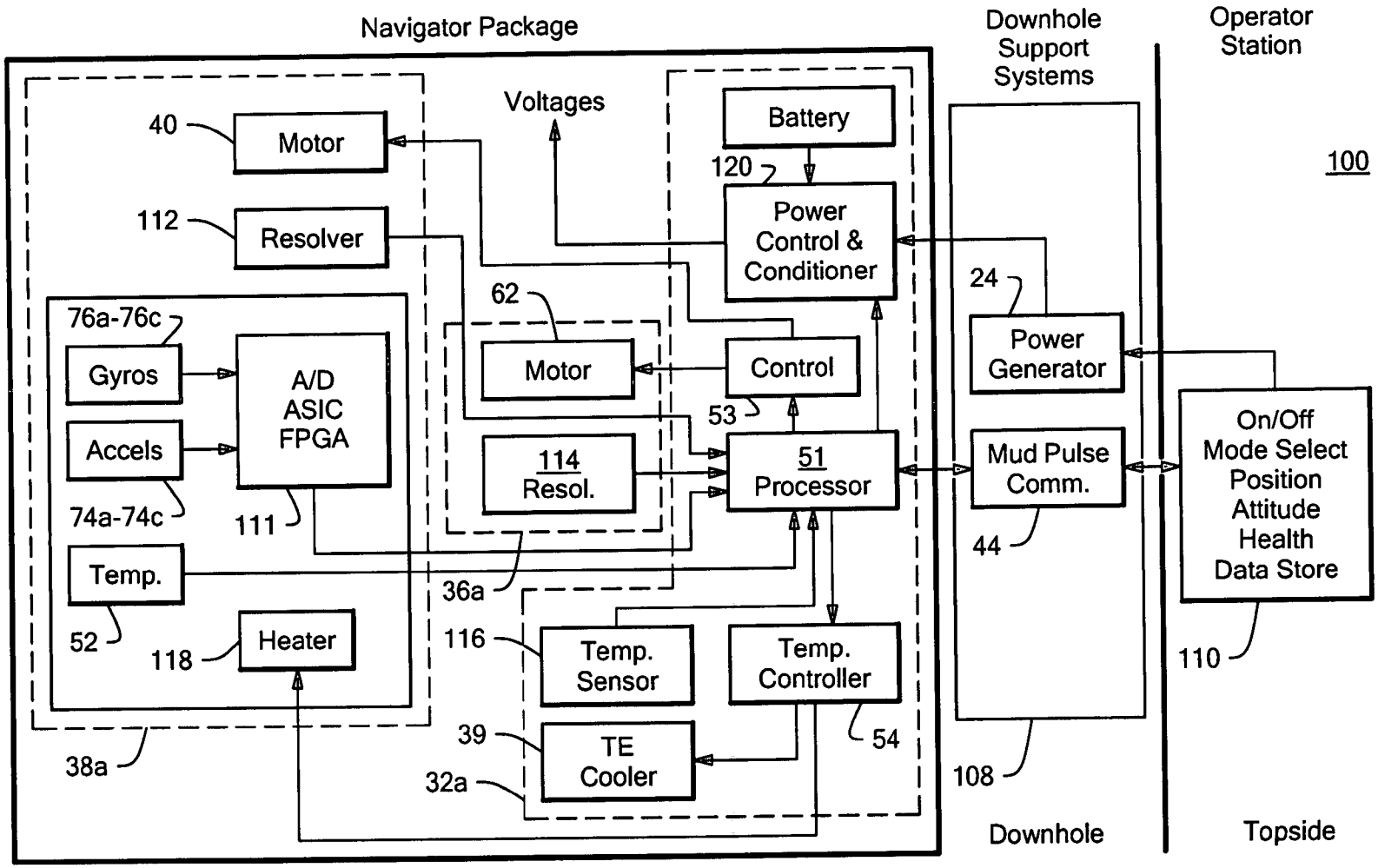
FIG. 7 is a functional block diagram of the borehole navigation system shown in FIG. 2.

A block diagram of navigation system 100, FIG. 7, includes elements from inner gimbal 38*a*, outer gimbal 36*a*, housing 32*a*, down-hole support system 108, and operator station 110. On inner gimbal 38*a*, information from gyroscopes 76*a*–76*c* and accelerometers 74*a*–74*c* are sent to inner gimbal logic circuits 111, which include an analog digital converter (A/D), ASICs, and FPGAs. An output signal from logic circuit 111 is transmitted to processor 51 located on housing 32*a*. Temperature sensor 52 on inner gimbal 38*a* transmits temperature information to processor 51. A resolver 114 on outer gimbal 36*a* and perhaps a resolver 112 on inner gimbal 38*a* each transmit location information of their corresponding gimbal to processor 51. Processor 51 in turn transmits one or more signals to a control module 53 on housing 32*a* that transmits a signal to motors 62 and 40 on outer gimbal 36*a* and inner gimbal 38*a* respectively, to control the orientation of each gimbal.

Processor 51 also accepts temperature information from temperature sensor 116 located on housing 32*a* about the housing temperature. In response to temperature information received from sensors 116 and 52, processor 51 transmits a signal to temperature controller 54 which controls the operations of thermoelectric coolers 39 on housing 32*a* and heater 118 on inner gimbal 38*a*. Processor 51 also controls operation of a power control and conditioner module 120 that provides the appropriate voltages to electronics on inner gimbal 38*a*, outer gimbal 36*a* and housing 32*a*.

Mud pulse data communicator 44 communicates information in between processor 51 and operator station 110. Operator station 110 controls the operation of DC power generator 24 which transmits generated power to power control and conditioner 120. Operator station 110 controls general operation of the drilling and navigation system such as turning the drill on and off, selecting the mode of operation of proximity electronics, receiving information on the position and attitude of the navigation system, determining the health of the navigation system, storing data associated with the navigation system, and steering the drill if this is not done down-hole by processor 51.

Figure 8:
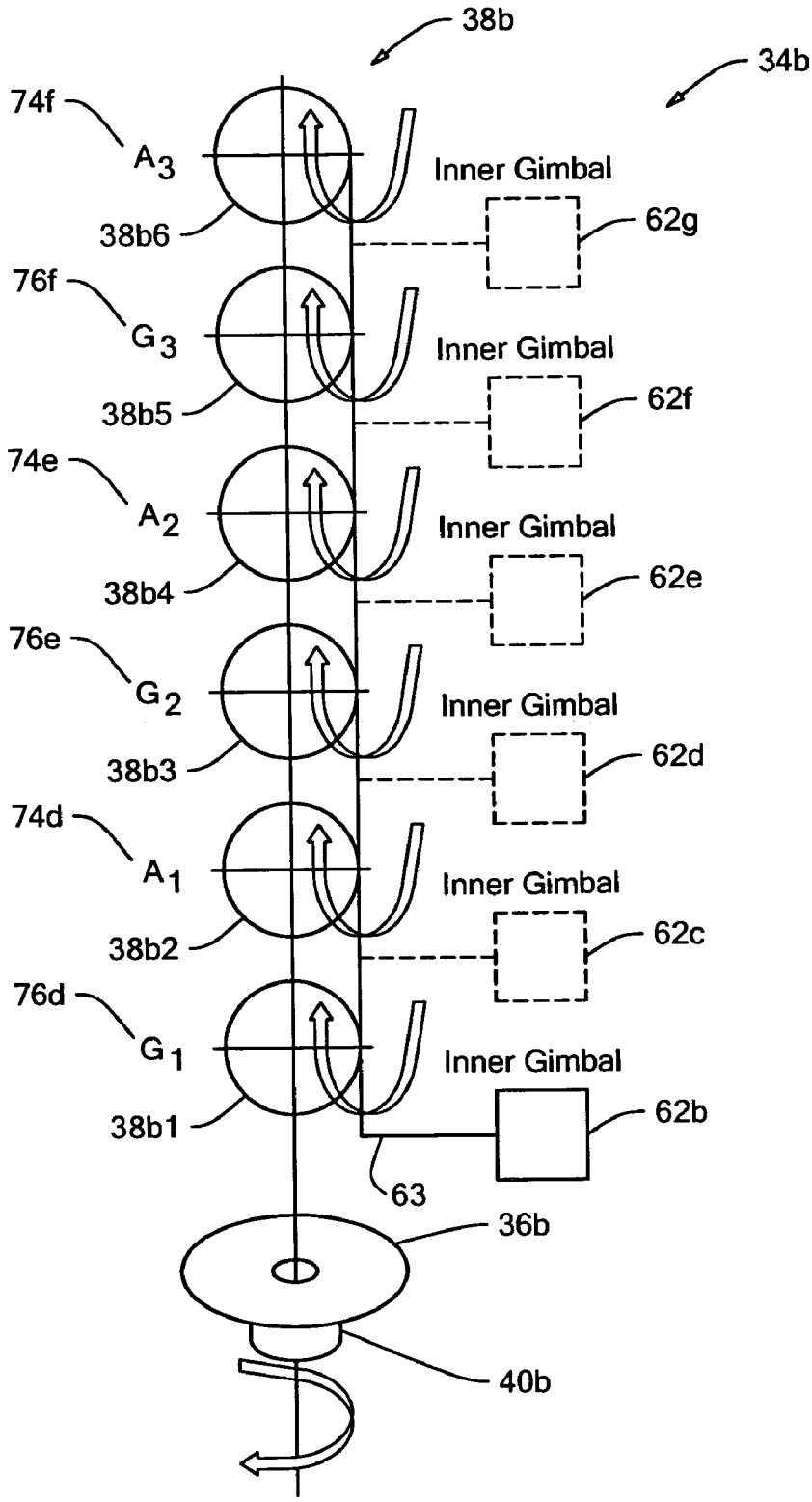
FIG. 8 is a schematic diagram of another embodiment of the borehole navigation system shown in FIG. 1 in which the housing includes one outer gimbal and six inner gimbals, each inner gimbal including one inertial sensor.

FIG. 8 shows another embodiment of gimbal assembly 34*b* that includes one outer gimbal 36*b* and six parallel inner gimbals 38*b*1–38*b*6. Inner gimbals 38*b*1, 38*b*3, and 38*b*5 each have one gyro 76*d*, 76*e*, and 76*f*, respectively, located thereon and inner gimbals 38*b*2, 38*b*4, and 38*b*6 each have one accelerometer 74*d*, 74*e*, and 74*f*, respectively, located thereon. There could be some number other than six inner gimbals, such as three inner gimbals if each inner gimbal contained two sensors, or two inner gimbals if each inner gimbal contained three sensors, or some other number less than or greater than six if there were other numbers of sensors on inner gimbals or if there were redundant sensors. Outer gimbal motor 40*b* drives outer gimbal 36*b* and inner gimbal motor 62*b* drives each of the inner gimbals 38*b*1–38*b*6 through a gear train 63 such as a bicycle chain gear. Alternatively, six gimbal motors 62*b*–62*g* could each drive one of inner gimbals 38*b*1–38*b*6. Each accelerometer 74*d*–74*f* and each gyro 76*d*–76*f* is located on a circuit board in corresponding inner gimbal 38*b*1–38*b*6 and includes proximity electronics on the associated circuit board, including for example an. ASIC and gate array. A sensor, such as a gyro or an accelerometer, may be on one side of the circuit board and the programmable gate array and ASIC may be on the other side.

The input axes of each of the gyros 76*d*–76*f* are mutually oriented orthogonally to each other, as are the input axes of the accelerometers 74*d*–74*f*. The input axes for the three gyros 76*d*–76*f*, and separately the three accelerometers 74*d*–74*f*, are preferably oriented orthogonally to each other by having the three accelerometers' or gyros' chip planes (if the sensors are MEMS devices) be three intersecting faces of a cube, with each cube face being on a separate inner gimbal and each inner gimbal axis being parallel to the diagonal of the cube that bisects the three cube faces. An inner gimbal axis thus makes an angle of arccos(1/sqrt(3))=54.73 degrees with the normal to its sensor chip plane. Having the sensor chip plane at an angle to the gimbal axis creates a smaller diameter multi-gimbal structure within the drill pipe diameter.

The three gyro 76*d*–76*f* input axes and three accelerometer 74*d*–74*f* input axes are preferably mutually orthogonal at the two 180° degree apart inner gimbal stops, and in between if the inner gimbals rotate in parallel, which can be accomplished by using one inner gimbal motor 62*b* that drives a gear train which rotates gyros 76*d*–76*f* and accelerometers 74*d*–74*f* stacked in an alternating configuration as shown in FIG. 8.

Each of the below described navigation while drilling techniques for FIGS. 9, 10 and 11 utilize as part of their approach a gyrocompass while a length of drill pipe is added to the drill string, such as 132 and 136 in FIG. 9, 152 and 162 in FIG. 10, and 172 and 184 in FIG. 11. During a gyrocompass, gyro and accelerometer data are collected at each of the four possible gimbal 180 degree cardinal orientations. Gyro data may also be collected during the slew between gyrocompass orientations. Least squares or Kalman filter estimation, as known to those skilled in the art, is used to determine the gyro and accelerometer biases, the Earth's rotation and gravity vectors, and from the slew data the gyro scale factors. From the Earth's rotation and gravity vectors in the outer gimbal frame, the attitude of the system relative to north and vertical is determined.

Figure 9:
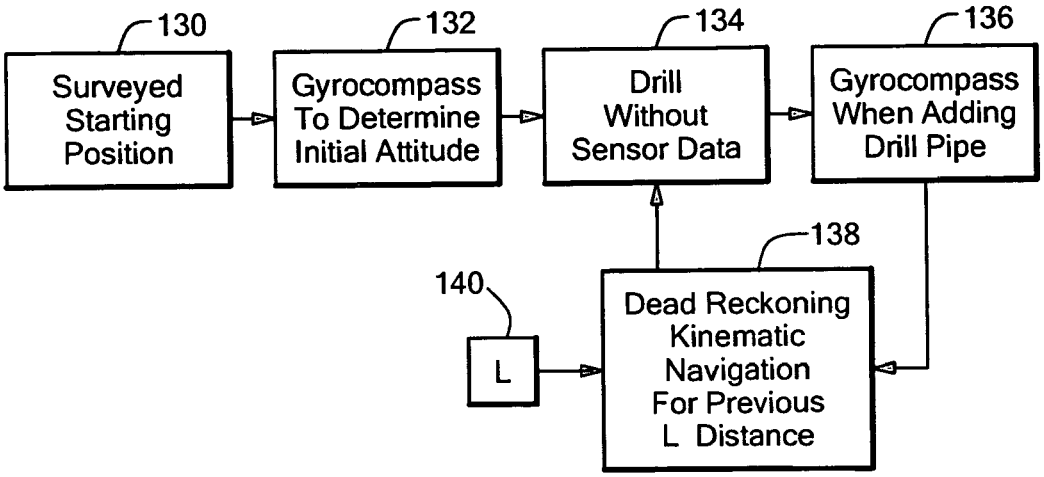
FIG. 9 is a flowchart showing a method of dead reckoning kinematic navigation while drilling that is used with the borehole navigation system of FIG. 2 or FIG. 8.
Figure 10:
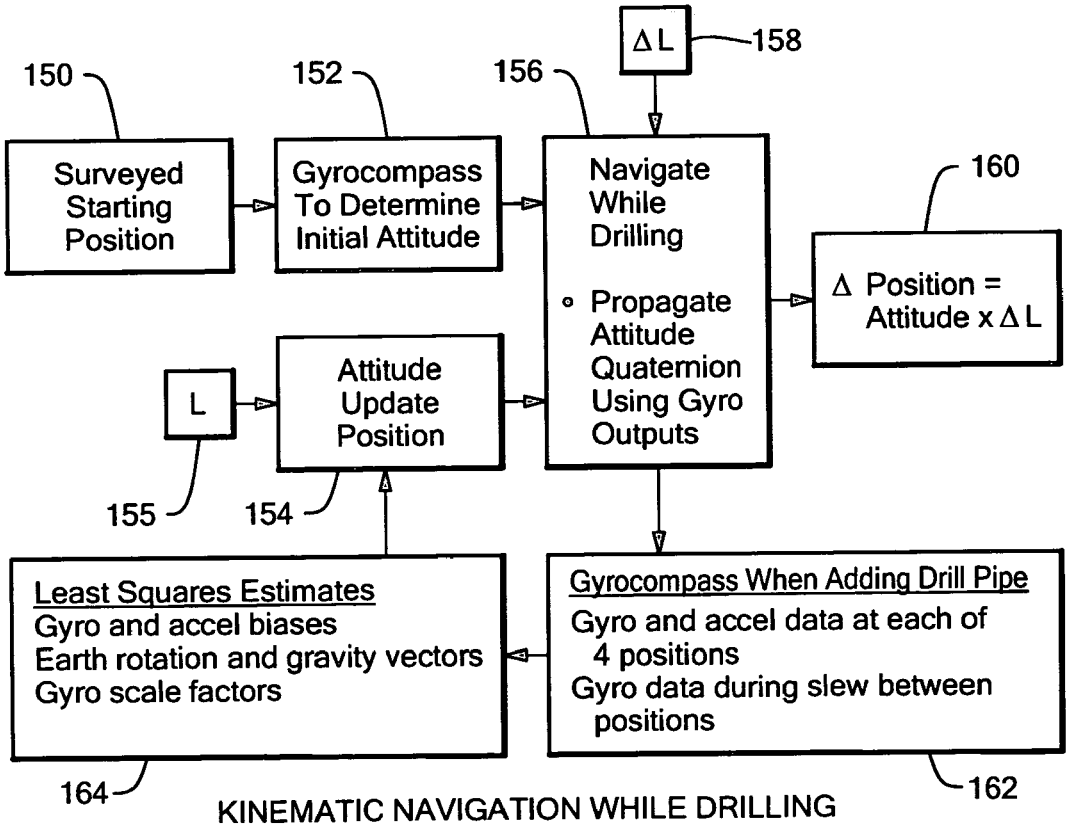
FIG. 10 is a flowchart showing a method of kinematic navigation while drilling that is used with the borehole navigation system of FIG. 2 or FIG. 8.

A common method for dead reckoning kinematic navigation while drilling begins at step 130, FIG. 9, with obtaining a surveyed starting position of the borehole. Typically, the starting point of the borehole can be very well surveyed, even on the ocean bottom under a drilling platform. For example, global positioning system (GPS) satellite radio navigation equipment can be used to determine the drilling rig position, which is then projected to the starting point of the borehole. At step 132, the initial attitude of the navigation system is determined by gyrocompassing, in which the inner and outer gimbals may be rotated. At step 134, drilling is performed without obtaining additional sensor data. At step 136, gyrocompassing is performed when an additional segment of drill pipe is added. The inner and outer gimbals maybe rotated again at step 136. At step 138, the location of the navigation system is determined by using dead reckoning kinematic navigation, which is performed by using attitude information from the gyros obtained at steps 132 and 136 and the length of pipe (L) that was added to go from step 132 to step 136. The segment of added drill pipe, which may be thirty feet or other lengths, is typically known or can be accurately measured. Alternatively, at step 140, the length of added drill pipe (L) can be obtained from an external source. At step 134, drilling is again performed without taking additional sensor data, and the process 136, etc. repeated.

The navigation method of FIG. 9 does not depend on the particular thirty foot pipe length (presently standard in the drilling industry) chosen in the discussed example. Sometimes drill pipe is added in three thirty-foot segments, or a coil of continuous drill pipe is let down the hole so that drilling might be stopped only every 90 or several hundred feet.

Since borehole drilling will not necessarily follow a smooth minimum-curvature path from one gyrocompass location to the next, as is assumed in dead reckoning kinematic navigation, it may be desirable to navigate while drilling to the next gyrocompass location, in which the position of the initial point is propagated to the second point while drilling. To accomplish this, a method for kinematic navigation while drilling, FIG. 10, can be used, which begins at 150 with obtaining a surveyed starting position of the borehole. At step 152, the initial attitude of the navigation system is determined by gyrocompassing.

Kinematic navigation while drilling is accomplished at step 156, where attitude is propagated using the gyro outputs while the gimbals might be carouseled and/or indexed. Information about the amount the drill pipe advanced, ΔL, is obtained at step 158, and at step 160, the increment in position is determined by multiplying the current attitude determined at step 156 by ΔL. Alternatively, rather than knowing each ΔL increment while drilling, if it is known that the drill pipe has gone L=30 feet when the drilling stops, and the time duration required for drilling the thirty feet is known, then the kinematic navigation while drilling can be ex-post accomplished after the drilling using saved attitude information during drilling by assuming that the drill bit advanced at a uniform velocity.

At step 162, gyrocompass data is collected while drill pipe is added to the drill string, and the gyrocompass data processing is done at step 164. The navigation while drilling position is Kalman filter updated at step 154 using the gyrocompass attitude information and the length L of the drill pipe measured in step 155, and the process is repeated at 156.

Figure 11:
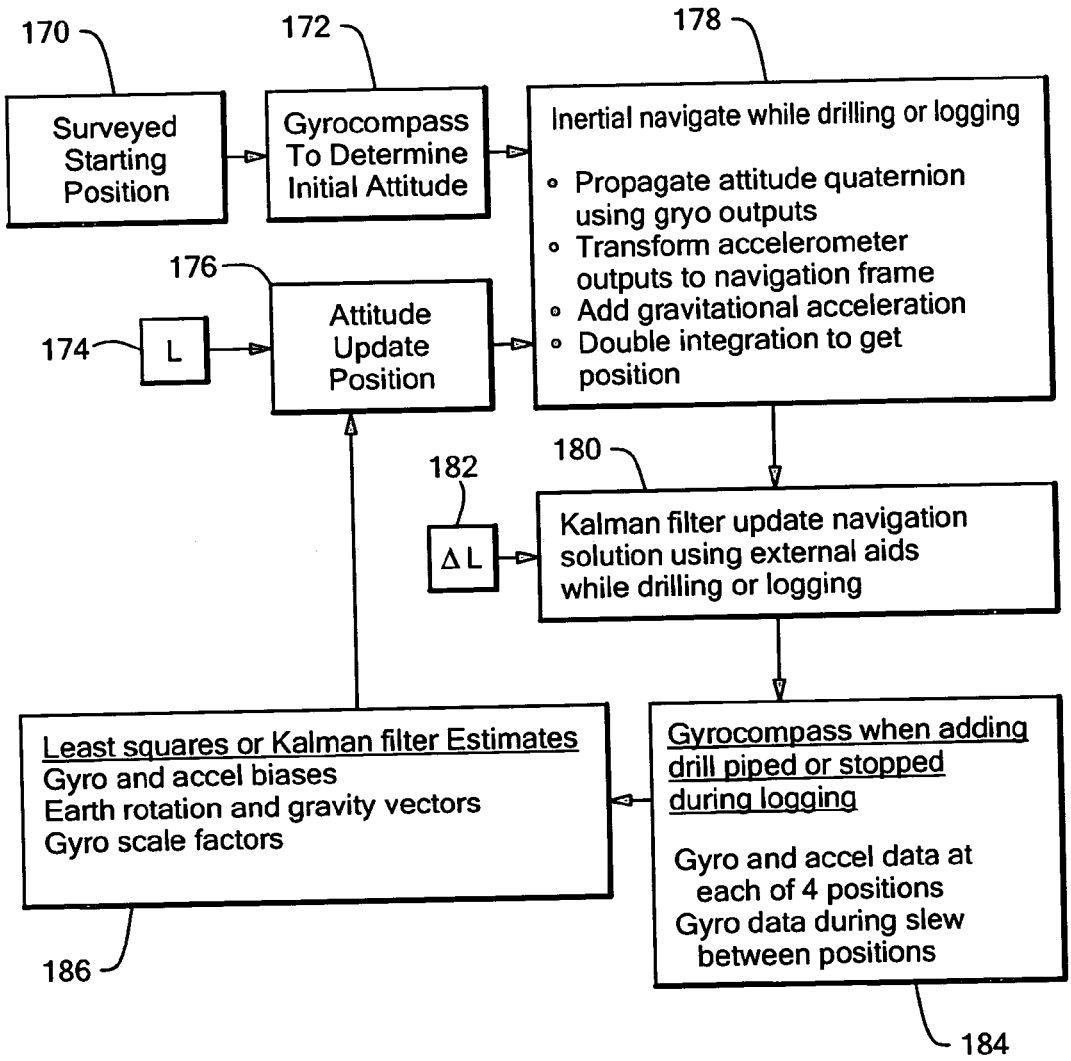
FIG. 11 is a flowchart of a method for inertial navigation while drilling or logging that is used with the borehole navigation system of FIG. 2 or FIG. 8.

If accelerometer data exists, i.e., if the accelerometer proof masses do not hit their stops during the shock and vibration of drilling, or if they only do so occasionally where navigation can be interpolated through the shock, then inertial navigation while drilling with external aids is preferably used as shown in FIG. 11. The method for inertial navigation, which uses accelerometer as well as gyro information, begins at step 170, FIG. 11, with obtaining a surveyed starting position. At step 172, the initial attitude of the navigation system is determined by gyrocompass.

Using the information obtained at step 172 (or at step 176 after the first position), inertial navigation at step 178 is accomplished by propagating the attitude using the gyro information, transforming the accelerometer outputs to a navigation frame, adding information from a gravitational acceleration model, and double integrating to get the position of the navigation system. At step 180, a Kalman filter update is performed using information about the incremental length of pipe ΔL obtained at step 182. While a length of drill pipe is added at step 184, gyro and accelerometer data are obtained during the gyrocompass scenario positions, and at step 186 a least squares or Kalman filter estimate is performed to determine the gyro and accelerometer biases, the Earth's rotation and gravity vectors, and gyro scale factors. At step 176, the attitude and position are Kalman filter updated using the gyrocompass attitude information and the length of pipe L information measured in step 174, which result is used at step 178 to continue inertial navigation while drilling. The gimbals might be carouseled and/or indexed while inertially navigating while drilling.

With the method of FIG. 11, incremental pipe advance information ΔL used in the external aid Kalman filter update prevents the unbounded growth of inertial navigation errors, and typically gets similar propagation errors as that obtained in kinematic navigation. However, inertial navigation could have smaller error propagation because the accelerometer data provides extra information, provided that the accelerometers are not hitting their stops. An occasional overshock event can be tolerated, because the drill pipe advance is typically very slow and an occasional accelerometer outage can be interpolated through.

For inertial navigation, a model of the Earth's gravitation field is preferably used to add to the non-gravitational acceleration measured by the accelerometers. The deflection of the vertical due to gravity anomalies also is preferably modeled down the borehole to correctly interpret the result of vertical determination by the accelerometers in a gyrocompass.

Gimbal Operation

In one embodiment of navigation between gyrocompassing, dual orthogonal gimbals 36 and 38, FIG. 3, can be commanded to rotate ±180° between stops, with a latch mechanism at each gimbal position. Thus, accurate gimbal readout and motion control is not needed if indexing only is utilized. However, in another embodiment, two, three or more gimbals continuously carousel during navigation between gyrocompassing.

The preferred hybrid method of operating the gimbals is with outer gimbal 36 capable of continuous multi-360° revolutions with gimbal angle readout and slip rings or rotary transformers with optical communications link, and with inner gimbal 38 orthogonal to the outer gimbal capable of doing a +180° rotation, dwelling, and then a −180° rotation, etc., between stops with twisted wire or wire twist capsule and with or without gimbal angle readout. Inner gimbal 38 can be stopped at other positions, such as 90° between the 180° apart stops.

Continuous rotation of outer gimbal 36 and discrete indexing of inner gimbal 38 is preferable because the space available along the longitudinal axis of drill pipe 18 allows a more complicated outer gimbal 36 structure that permits drill pipe rotation during drilling to be converted to the desired carouseled motion by serving the outer gimbal to the gyro integrated angle outputs plus the desired carousel angle motion. The simplified structure of inner gimbal 38 is consistent with the restricted diameter in drill pipe 18, and is adequate to allow the required gyrocompass scenarios. During navigating while drilling, continuous carouseling +360° and −360° of the outer gimbal, and discrete indexing +180° and then −180° of the inner gimbal, averages out the effects of gyro and accelerometer bias errors, and unwinds the effects of gyro scale factor errors insofar as the carousel and indexing motions is concerned.

Gyrocompassing Method

When drilling is stopped to add a length of drill pipe, a gyrocompass and other sensor calibration operations may be performed using data obtained at and between four cardinal gimbal positions 180° apart, as follows:

(1) At the first gimbal position (all gimbal angles zero), high rate data is collected and digitally filtered for a period of time from all sensors, which can include three orthogonal gyros, three orthogonal accelerometers, and a three-axis magnetometer if available. This period of time generally is on the order of one minute but can be greater or smaller depending on the trade between accuracy of attitude and drill delay time;

(2) Then the outer gimbal is commanded to rotate or index for +180° in about 1 or a few seconds more or less, as controlled by the gimbal angle readout (or between stops if readout does not exist). Since the rotation is for a precise 180°, data collected during this rotation and subsequent rotations can be used to calibrate gyro scale factors for gyros at known non-orthogonal input axis (IA) orientations relative to the gimbal directions. Hence, none of the three orthogonal gyro IAs should be orthogonal to both gimbal axis directions. For instance, one IA can be parallel to the outer gimbal when at the cardinal inner gimbal orientations and the other two IAs can be at 45° angles to the inner gimbal, or some other more equally spaced non-orthogonal-to-gimbal orientation for the orthogonal set of gyro input axes, such as in FIGS. 4 and 5B;

(3) Data is collected at the second gyrocompass orientation for a minute more or less;

(4) The inner gimbal is indexed +180° between its stops with data being collected during the rotation;

(5) Data is collected at the third gyrocompass orientation for a minute more or less;

(6) The outer gimbal is indexed or rotated −180° with data being collected during the rotation. It is important for calibration reasons that the outer gimbal be rotated −180° rather than +180°, even though the outer gimbal has complete rotary freedom. The effects of gyro bias and the Earth's rotation rate increases the magnitude of the integral of the gyro output in a 180° rotation for one direction of rotation, and decreases this magnitude for the other direction of rotation. Thus even if not included exactly correctly in analyzing the data, the gyro scale factor calibration using the combined +180° and −180° slews is insensitive to these effects;

(7) Data is collected at the fourth gyrocompass orientation for a minute more or less; and (8) The inner gimbal is indexed −180° with data being collected during the rotation, where the second inner gimbal rotation has to be in the opposite direction of the first, because of the inner gimbal stops and for the same reasons as described in step (6).

Gyrocompass Data Processing

From the data at the four fixed gyrocompass orientations compensated for thermal variations, the gyroscope, accelerometer, and possibly magnetometer biases are calibrated, and the vector components of the local vertical gravity, of the Earth's rotation angular velocity, and possibly of the Earth's magnetic field in the outer gimbal frame may be calculated, as described below. These quantities may also be estimated from the data obtained during continuous rotation of the gimbals or at other positions. The accuracy of the Earth's gravity vector estimate depends on the short term stability of the accelerometer biases and the long term stability of the accelerometer scale factors, whereas the accuracy of the Earth's angular velocity estimate depends only on the short term stability of the gyro biases and scale factors, since the gyro scale factors are calibrated in the slew between gyrocompass positions.

The data from MEMS gyroscopes and accelerometers may be A/D sampled at up to approximately 5 MHz. Digital signal processing and digital filtering is performed on the data with output to processor 51 in FIG. 7 at approximately 600 Hz or 1 kHz. At each gyrocompass position, the gyro angle rate data and the accelerometer acceleration data at the 600 Hz or 1 kHz sample rate are multiplied by the sample time interval and accumulated to get the accumulated gyro angle output and the accumulated accelerometer velocity output as functions of time. The slopes of least squares straight line fits to the accumulated data gives the average gyro rate data and the average accelerometer acceleration data at each of the four gyrocompass positions for three orthogonal gyros and three orthogonal accelerometers. Or some other filter, such as a Kalman filter, can be used to get the average of the sensor outputs at each gyrocompass position.

If the gyrocompass information is used to determine azimuth, the assumption is preferably made that drill pipe 18 is stationary during the gyrocompass operation. Since the drill pipe is lifted off the bottom of the hole when a length of pipe is added, there could be some rotation of the drill pipe. The magnetometer data could be biased in its measurement of the Earth's magnetic field direction, but the change in magnetometer direction determination between the start and end of data taking at each gyrocompass position and across all four gyrocompass positions can be used to correct the gyro data and the accelerometer data for the rotation of the drill string during the gyrocompass operation, if there were a three-axis magnetometer in the system.

A better alternative would be to extend a brake against the borehole wall to prevent the drill pipe from rotating during the gyrocompass operation. However, the use of a brake might not be possible. For instance, when drilling from a ship that is not rigidly attached to the ocean bottom, the ship and drill pipe could be going up and down with wave motion. The motion of the ship could be very accurately monitored with sub-centimeter accuracy phase tracking GPS receivers, and this information sent to the navigation system at the bottom of the drill pipe, if adequate communications exist. Therefore, the period, phase, and amplitude (after modeling of the elasticity of the drill pipe) of the up and down motion and any excited rotary motion would be known and appropriate signal processing could separate out the DC levels of the gyroscope and accelerometer outputs. Long enough dwells at each gyrocompass position could also be used to separate out the DC values of the sensor outputs at each gyrocompass position.

In the following, the formulas are given for gyrocompassing assuming no rotation.

The transformation from the inner gimbal frame to the outer gimbal frame is given by:

$$\begin{bmatrix} 1 & 0 & 0 \\ 0 & \cos\theta_o & \sin\theta_o \\ 0 & -\sin\theta_o & \cos\theta_o \end{bmatrix} \begin{bmatrix} \cos\theta_i & \sin\theta_i & 0 \\ -\sin\theta_i & \cos\theta_i & 0 \\ 0 & 0 & 1 \end{bmatrix} \tag{1}$$

where $\theta_i$, $\theta_o$ are the inner and outer gimbal angles, respectively.

Assume that the gyro and accelerometer input axes (IA) in the inner gimbal frame have the orientations $$IA_1 = \begin{bmatrix} 1 \\ 0 \\ 0 \end{bmatrix}, IA_2 = \begin{bmatrix} 0 \\ \cos 45° \\ \sin 45° \end{bmatrix}, IA_3 = \begin{bmatrix} 0 \\ -\sin 45° \\ \cos 45° \end{bmatrix} \tag{2}$$

with $IA_1$ parallel to the outer gimbal axis at the cardinal gyrocompass positions and $IA_2$ and $IA_3$ at 45° angles to the inner gimbal axis.

Let $(\omega_1, \omega_2, \omega_3)$ in the outer gimbal frame be the input to a sensor (Earth's rotation inertial angular velocity for a gyro, specific force or nongravitational acceleration reaction up to gravity pulling down for an accelerometer).

Let $S_j$ be the scale factor and $B_j$ the bias of sensor j (j=1, 2, 3 for gyros and for accelerometers). The output of a triad of sensors, either gyros or accelerometers, at the four cardinal index positions of the gimbals are given in Table 1 below.

TABLE 1

Sensor outputs at dual gimbal gyrocompass cardinal positions

| Position | Sensor 1 | Sensor 2 | Sensor 3 |
|---|---|---|---|
| $\theta_i = 0°, \theta_o = 0°$ | $+S_{1\omega 1} + B_1$ | $+S_{2\omega 2} \cos 45°$<br>$+S_{2\omega 3} \sin 45° + B_2$ | $-S_{3\omega 2} \sin 45°$<br>$+S_{3\omega 3} \cos 45° + B_3$ |
| $\theta_i = 180°, \theta_o = 0°$ | $+S_{1\omega 1} + B_1$ | $-S_{2\omega 2} \cos 45°$<br>$-S_{2\omega 3} \sin 45° + B_2$ | $+S_{3\omega 2} \sin 45°$<br>$-S_{3\omega 3} \cos 45° + B_3$ |

TABLE 1-continued

Sensor outputs at dual gimbal gyrocompass cardinal positions

| Position | Sensor 1 | Sensor 2 | Sensor 3 |
|---|---|---|---|
| $\theta_i = 180°, \theta_o = 180°$ | $-S_{1\omega 1} + B_1$ | $+S_{2\omega 2} \cos 45°$<br>$-S_{2\omega 3} \sin 45° + B_2$ | $-S_{3\omega 2} \sin 45°$<br>$-S_{3\omega 3} \cos 45° + B_3$ |
| $\theta_i = 0°, \theta_o = 180°$ | $-S_{1\omega 1} + B_1$ | $-S_{2\omega 2} \cos 45°$<br>$+S_{2\omega 3} \sin 45° + B_2$ | $-S_{3\omega 2} \sin 45°$<br>$+S_{3\omega 3} \cos 45° + B_3$ |

If the orthogonal gyro and accelerometer IA orientations differ from those in equation (2), such as in FIGS. 5A and 5B, because, e.g., of packaging considerations, while still having the gyro IAs not orthogonal to all gimbal axes, then some other expressions than those in Table 1 for the theoretical values of the measurements would result. However, there would still be complete observability into the Earth's rate and gravity vector components in the outer gimbal frame.

For example, consider a MEMS accelerometer design in which the accelerometer IA is perpendicular to its chip plane, and a MEMS gyro design in which the gyro IA is in its chip plane, such as for sensors described in U.S. Pat. Nos. 5,126,812, 5,349,855 and 6,548,321, and PCT published application WO 03/031912 A2, all assigned to Draper Laboratory in Cambridge, Mass. Let the sensor chip planes be parallel to three adjacent faces of a cube for which the inner gimbal axis is a solid angle bisector. A choice of gyro orthogonal triad input axes for which the cube faces are chip planes is

| Gyro | x component | y component | z component |
|---|---|---|---|
| G1 | $-\sqrt{1/6}$ | $\sqrt{1/2}$ | $\sqrt{1/3}$ |
| G2 | $-\sqrt{1/6}$ | $-\sqrt{1/2}$ | $\sqrt{1/3}$ |
| G3 | $\sqrt{2/3}$ | 0.0 | $\sqrt{1/3}$ |

A choice of accelerometer orthogonal triad input axes with the same chip planes are

| Accel | x component | y component | z component |
|---|---|---|---|
| A1 | $\sqrt{2/3}$ | 0.0 | $\sqrt{1/3}$ |
| A2 | $-\sqrt{1/6}$ | $\sqrt{1/2}$ | $\sqrt{1/3}$ |
| A3 | $-\sqrt{1/6}$ | $-\sqrt{1/2}$ | $\sqrt{1/3}$ |

Or some other choice of orthogonal triad input axis orientations can be chosen, such as one which differs from the above by a rotation about the inner gimbal axis. The small misalignment angles of the gyro and accelerometer IAs not forming orthogonal triads would be calibrated on the surface before drilling commences, and compensated for.

Given the accelerometer scale factors (from surface calibrations) and the twelve average accelerometer measurements at four positions, one can then estimate the gravity vector and the accelerometer biases. Given the gyro scale factors either from surface calibrations or from calibration during the slew between gyro positions and the twelve average gyro measurements at four positions, one can then estimate the Earth's rotation inertial angular velocity vector and the gyro biases. Least squares or Kalman filter estimation can be used, where there are no perfect correlations between estimated parameters.

It is necessary to have an outer gimbal and an inner gimbal or stack of inner gimbals and at least four gimbal gyrocompass geometric positions to robustly and simultaneously estimate sensor biases and earth rotation angular velocity and gravity vector components. Gyro biases and possibly accelerometer biases are typically not stable enough to use surface calibrations of sensor biases to adequately estimate earth rotation angular velocity and gravity vector components without gimbals for extended periods of time in a borehole. Simultaneously estimating sensor biases and earth rotation angular velocity and gravity vector components with single gimbal gyrocompassing is possible given the constraint that the lengths of the vectors are known, but correlations among the estimated parameters are high, uncertainties and sensitivities to systematic errors are magnified, and convergence of the required nonlinear estimation technique to the correct answer is problematical in all situations without a very good first guess, because knowing the magnitude of a vector does not convey information as to the signs of the vector components.

Knowing the local vertical vector and the Earth's rotation angular velocity vector in the outer gimbal coordinate frame, the horizontal north direction is calculated (if away from the Earth's poles). Hence the azimuth and local vertical orientation of the drill bit has been determined, so that the operator can properly steer the drill bit, or the steering can be autonomously done by processor 51 in the drill pipe (if there is a means to steer at the drill bit or along the drill string in a closed loop).

Borehole Gravimetry

Non-vibrating (pendulous or translational proof mass) MEMS accelerometers may allow local vertical determination with required accuracy, even if the gravity magnitude measurement is not made with sufficient accuracy for geophysical survey purposes. Oscillating type accelerometers, where proof masses put opposing silicon or quartz resonators into tension and compression under acceleration and the measure of acceleration is the difference frequency of the resonators, can possibly have the required long term scale factor stability for determining the gravity magnitude (length of gravity vector measured in the gyrocompass operation) with sub-μg accuracy, with only short term stability required of the biases for MEMS oscillating accelerometers that fit within the small dual-gimbaled borehole navigation system.

Sub-μg performance is possible with increased accelerometer proof mass, although the proof mass is thereby more likely to hit its stops during the shock and vibration of drilling. However, the kinematic navigation while drilling approach only needs the gyro data while drilling, whereas the gyrocompass while not drilling needs both the gyro and the accelerometer data, as does aided inertial navigation while drilling.

Calibration of Gyro Scale Factors During Gyrocompass Slews or Multi-Revolution Slews From the data taken during gimbal ±180° slews between gyrocompass positions compensated for thermal variations, the gyro scale factors may be calibrated, or the data taken during positive and negative multi-revolution rotations of the outer gimbal may be used. The thermal sensitivity model coefficients (which may be calibrated topside before drilling commences) have only to provide corrections for small temperature variations over a few minutes.

For a gyro IA along a gimbal rotation axis, the integral of the gyro angle rate data during the gimbal 180° slew should equal 180° plus the effect of bias plus the effect of the Earth's rotation rate during the slew, similarly for a multi-revolution slew. For a gyro IA at some fixed angle to a gimbal rotation axis such as 45°, the integral of the gyro angle rate data during the gimbal 180° slew should equal 180° cos(45°) plus the effect of bias plus the effect of the Earth's rotation rate during the slew. For a slew into stops for which there are no gimbal angle readouts during the slew, a time scenario can be assumed (as derived from laboratory experiments on gimbal motor performance) for calculating the effect of the Earth's rotation rate during the slew.

Since the integral of a gyro's output from the +180° slew is of the opposite sign from that from the −180° slew (for a gyro not orthogonal to the given gimbal axis), the effects of gyro bias and the Earth's rotation rate will increase one by the same amount that it decreases the other, if the same pattern of time history of gyro IA relative to the Earth's rotation vector is repeated in the reverse direction in the two slews.

The estimate of the gyro scale factor SF given by:

$$SF = \frac{|\text{integral of gryo output for} + 180^\circ \text{ slew}| + |\text{integral of gryo output for} - 180^\circ \text{ slew}|}{2 \times 180^\circ \times \cos(\text{angle of } IA \text{ to gimbal axis})}$$

is therefore insensitive to the effects of the Earth's rotation rate and the gyro bias, and similarly for positive and negative multi-revolution slews, where 180° in the above formula is replaced by n×360°, where n is the number of revolutions.

If the gyro IA is not orthogonal to both pairs of ±180° slews, then the gyro scale factor estimate is preferably taken to be the average of the two estimates, or the weighted average with the weights being the cosines of the angles of the IA to the gimbal axes.

Nominal (topside or last calibration) values for the gyro scale factors are assumed during the gyro estimations as described above for the gyrocompass data processing. Then the resulting gyro bias and the Earth's rotation vector estimates are preferably applied to estimating the gyro scale factors during the 180° slews. These gyro scale factor estimates preferably are then used to repeat the gyrocompass estimates of gyro biases and the Earth's rotation axis direction, and then the gyro scale factor slew estimates are repeated with the new values of gyro biases and the Earth's rotation direction, etc., the iteration continuing until convergence is obtained. Alternatively, a nonlinear least squares estimate can be made of all the parameters simultaneously from all the gyrocompass and slew data combined.

It is assumed that the angles between the sensor axes and the gimbal axes and scale factor, bias, and alignment temperature sensitivities may be calibrated topside by putting the system on a multi-axis test table and slewing and tumbling about various table axes for various MEMS navigation system gimbal orientations and various temperatures. Also, possibly calibrated topside are any accelerometer $g^2$ sensitivities, any gyro g sensitivities, and any gyro scale factor nonlinearities between sensing high slew rates and low earth-rate inputs.

Accuracy of Sensor Data

The accuracy of measurements at a given gyrocompass orientation depends on the gyro rate white noise (which causes angle random walk), the accelerometer acceleration white noise (which causes velocity random walk), other sensor noise processes, and the stability of the accelerometer scale factor. The accuracy of the measurement at a given gyrocompass position will in general improve as the square root of the time at the position. However, the time at a position cannot be increased much beyond one or a few minutes, because four times this dwell time should not be much longer than the time it takes to add a new length of drill pipe, due to the very large cost of any down time during the drilling process.

Since the 180° slew between positions takes much less time than the gyrocompass dwells at the positions, the scale factor calibration can be less accurate than the gyrocompass calibration, offset however by having a larger rate input during the slew. Preferably, there are commensurate times for dwelling at a position and for slewing between positions. For instance, if the gyrocompass accuracy can measure the earth's rotation vector direction to $10^{-3}$ radians, then the gyrocompass slew calibration should measure gyro scale factor to at least a part-in-a-thousand accuracy, unless the gyro scale factor were adequately stable from the surface calibration. Better scale factor accuracy is desirable for navigating while drilling, but the requirements while drilling can be ameliorated by outer gimbal ±360° carouseling relative to inertial space and by ±180° inner gimbal indexing during drilling, and by external aids (such as from length of pipe going down the drill hole and from magnetometer data).

The technology of the MEMS gyro allows sub-degree-per-hour gyro resolution (improving with time) and the capability to measure hundreds of degrees-per-second rotations. In one embodiment of a MEMS gyro, the variation in the induced charge on a vibrating capacitor plate from a charge on a stationary capacitor plate is measured, where the same voltage reference that puts the charge on the stationary plate is used as a comparator in the A/D conversion of the voltage from the charge on the vibrating plate. Therefore, the measurement of angle rate is insensitive to first order to the inaccuracy of the voltage reference.

The above described gyrocompassing and calibration scheme and the below described kinematic or inertial navigation schemes between gyrocompasses could be accomplished by carouseling, e.g., slower continuous ±360° rotations about two or more axes. The rapid ±180° indexing on the inner gimbal and ±180° rotation on the outer gimbal with dwells at the cardinal gyrocompass positions and ±360° outer gimbal carouseling during navigation while drilling is described herein, because it typically results in simpler and more compact gimbal hardware for fitting within the drill pipe.

Carouseling and Indexing to Average Out the Effect of Bias Errors During Navigating while Drilling In order to average out the effect of gyro and accelerometer bias errors during navigation while drilling, the inner gimbal or gimbals are indexed +180° and then −180° between their stops about every minute. The outer gimbal axis is also carouseled +360° and then −360° at an inertial carousel rate that is half (or some other fraction) of the indexing rate to similarly average out the effect of gyro and accelerometer bias errors. The outer gimbal could be indexed ±180° instead, but since the outer gimbal has continuous rotation capability the carousel approach is preferred. The inner gimbal axis could also be carouseled instead of indexed.

In order to carousel the outer gimbal axis, add an increasing ramp in angle to the integral of the virtual gyro g output to which the outer gimbal control is servoed, and then add a decreasing ramp in angle. Since no gyro IA is necessarily directly along the outer gimbal axis, choose the virtual gyro $g=\lambda_1 g_1+\lambda_2 g_2+\lambda_3 g_3$ to have output that is the linear combination of real gyro $g_i$ outputs, which is along the outer gimbal axis. Attitude quaternion propagation is done during indexing and carouseling as well as between indexing.

Servoing the outer gimbal to the gyro integrated angle outputs plus the desired carousel angle eliminates the effect of gyro scale factor errors due to drill pipe rotation. The ±360° outer gimbal inertial carouseling and the ±180° inner gimbal indexing to average out the effect of gyro and accelerometer bias errors also unwinds the effect of gyro scale factor errors due to the carouseling and indexing (but not due to any small lateral angular motion of the drill pipe). If the carouseling were always in one direction, then the effect of gyro scale factor errors due to carouseling would build up continuously, which is why there is a periodic reversal of outer gimbal carousel direction. The existence of stops requires that there is reversal of inner gimbal indexing direction, which is also needed to unwind the effect of gyro scale factor errors due to the indexing motion.

The canceling of the effect of gyro and accelerometer bias errors that are constant during the carouseling or indexing cycle is only exact if the carouseling or indexing is relative to inertial space. This of course occurs with gyro control of the outer gimbal carousel axis, but does not exactly occur for the inner gimbal axis, the small discrepancy being due to any small drill pipe lateral angular rotation and to the Earth's rotation during the short carouseling and indexing cycle durations. This therefore provides only a first order canceling of errors. However this method also may include any manner of moving the gimbals which exactly cancels out the gyro and accelerometer bias errors.

To do carouseling or indexing relative to inertial space, three or more gimbals would be required. Single or stacked inner gimbal ±180° indexing into stops, with twist capsules or twist wires and with or without gimbal angle readouts along with outer gimbal ±360° carouseling with gimbal angle readout and slip rings or rotary transformers and optical communications link while canceling drill pipe rotation as seen by the sensors is a practical way within drill pipe diameter restrictions to get most of the bias error cancellation, gyro scale factor error unwinding, gyrocompassing calibration, and other benefits that multiple gimbals allow, without having more than two gimbals, or a stack or inner gimbals within an outer gimbal. However, this invention also covers carrying out the described methods with nesting of more than two gimbals either with indexing or carouseling.

Stacked Inner Gimbal Navigation System

The borehole navigation system described herein may not only include a single inner gimbal within an outer gimbal, but may also include a stack of parallel inner gimbals within and orthogonal to an outer gimbal, as described above with respect to FIG. 8.

Figure 12A:
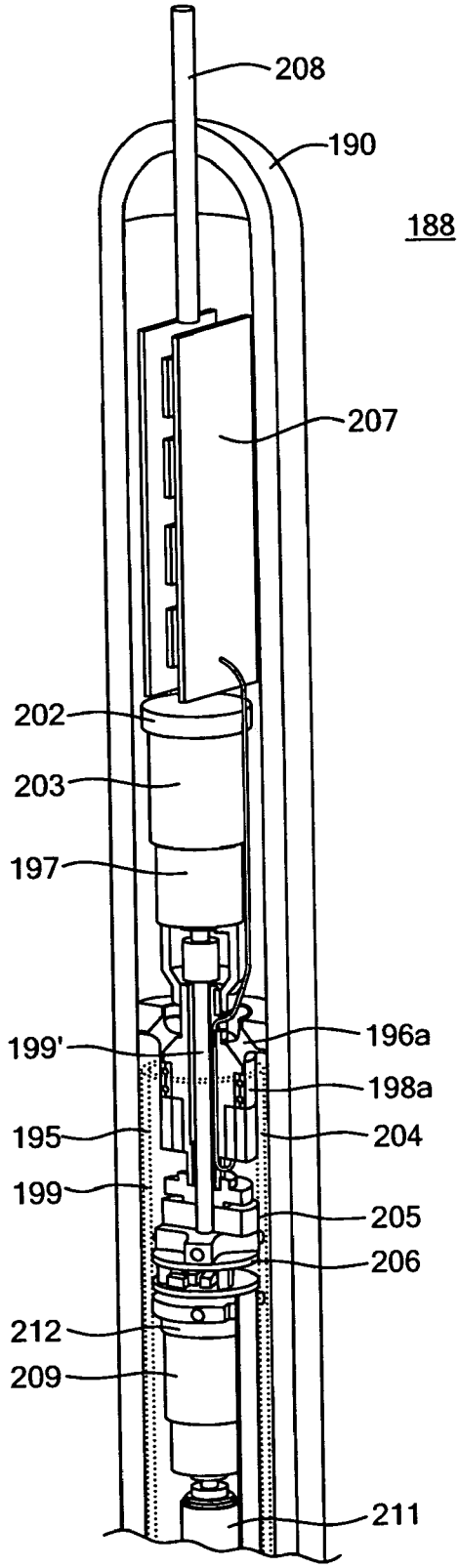
FIG. 12 is a schematic diagram of another embodiment of the borehole navigation system of FIGS. 2 and 8 in which the navigation system includes one outer gimbal, three inner gimbals, and a rack and pinion gear.
Figure 12B:
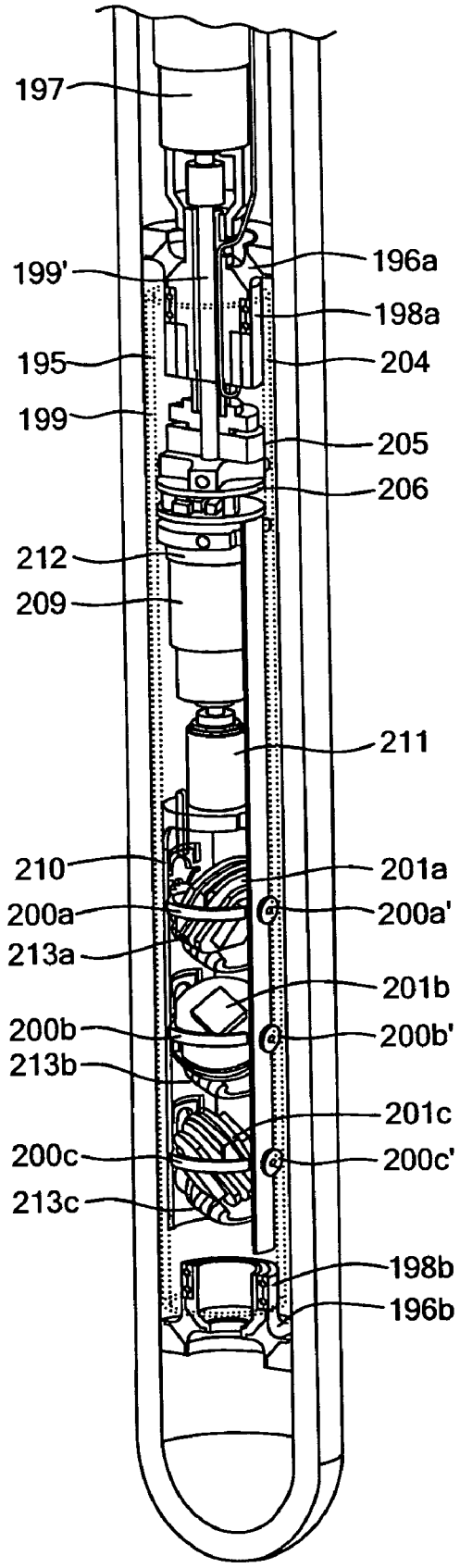

FIGS. 12A and 12B show another embodiment of the stacked inner gimbal borehole navigation system 188 that includes pressure vessel housing 190 having connected therein one outer gimbal 199 and three stacked and parallel inner gimbals 200*a*, 200*b*, 200*c*. Outer gimbal 199 has a shaft 199' that is oriented along the longitudinal axis of housing 190. Inner gimbals 200*a*, 200*b*, 200*c* are nested in and connected to outer gimbal 199 and respectively have shafts 200*a*', 200*b*', 200*c*' which are orthogonal to outer gimbal shaft 199'. Each inner gimbal includes a stack of circuit boards 201*a*, 201*b*, 201*c* including two inertial sensors, for example a MEMS gyro and a MEMS accelerometer, and associated electronic circuits. Outer gimbal 199 has complete rotary freedom on its bearings 198*a* and 198*b*, and includes a gimbal angle readout 202 such as a resolver or encoder. Outer gimbal 199 is connected to outer gimbal motor 203 via gear box 197; or there could be a direct motor drive. Outer gimbal 199 is supported within the housing pressure vessel with shock mounts 196*a* and 196*b*. The rotary parts of outer gimbal 199, which includes shaft 199' and outer gimbal housing 195, support the inner gimbal motor 209 and inner gimbal shafts 200*a*', 200*b*', 200*c*'.

Electric power is transmitted into outer gimbal 199 by coupling 204, such as a rotary transformer. Outer gimbal 199 may be electrically coupled to inner gimbals 200*a*, 200*b*, 200*c* by twist wires, twist capsules, slip rings or rotary transformers (twist wires 213*a*, 213*b*, 213*c* depicted to minimize inner gimbal diameters). Bidirectional communications from outside to inside the outer gimbal are accomplished via communications link 205, such as optical or electrostatic transmitters and receivers. Power transmission and communication may also be accomplished via slip rings, but since the outer gimbal may rotate tens of millions of times during its lifetime, less wear and greater reliability results if power transmission and communications are accomplished without physical contact between rotating parts.

Located inside the outer gimbal are gate array electronics 206 that receive the gyro and accelerometer data at a frequency of approximately 600 Hz or 1 kHz from the three inner gimbal gate arrays; multiplex the data together with temperature, gimbal angle, and other signals; and transmit the data across the optical, electrostatic, rotary transformer, or slip ring communications link 205 to the navigation and control computer or processor 207. Processor 207 commands the carousel and indexing gimbal rotations, temperature control loops, and other control loops in the system; computes the gyrocompass and other calibration solutions and the navigation solutions; and transmits and receives messages via a mud pulse or other such communications link 208 to the human operator on the surface. The navigation solutions computed by processor 207 include the determination of the attitude and position of the housing in the borehole.

An inner gimbal drive system includes inner gimbal motor 209, rotary-to-linear lead screw gear 211 and rack and pinion gear 210. Inner gimbal motor 209 is connected to rotary-to-linear gear 211 which translates the rotational movement of motor 209 to linear movement. Rotary-to-linear gear 211 is connected to rack and pinion gear 210. The drive system rotates inner gimbals 200*a*, 200*b*, 200*c* in parallel and to substantially maintain the three gyro input axes as orthogonal triads and the three accelerometer input axes as orthogonal triads.

Inner gimbal motor angle readout 212 provides information about the angle of inner gimbals 200*a*, 200*b*, 200*c*. Inner gimbals 200*a*, 200*b*, 200*c* are electrically connected to outer gimbal 199 by couplings 213*a*, 213*b*, 213*c* respectively such as twist cables, although they may alternatively be connected by slip rings.

Figure 13:
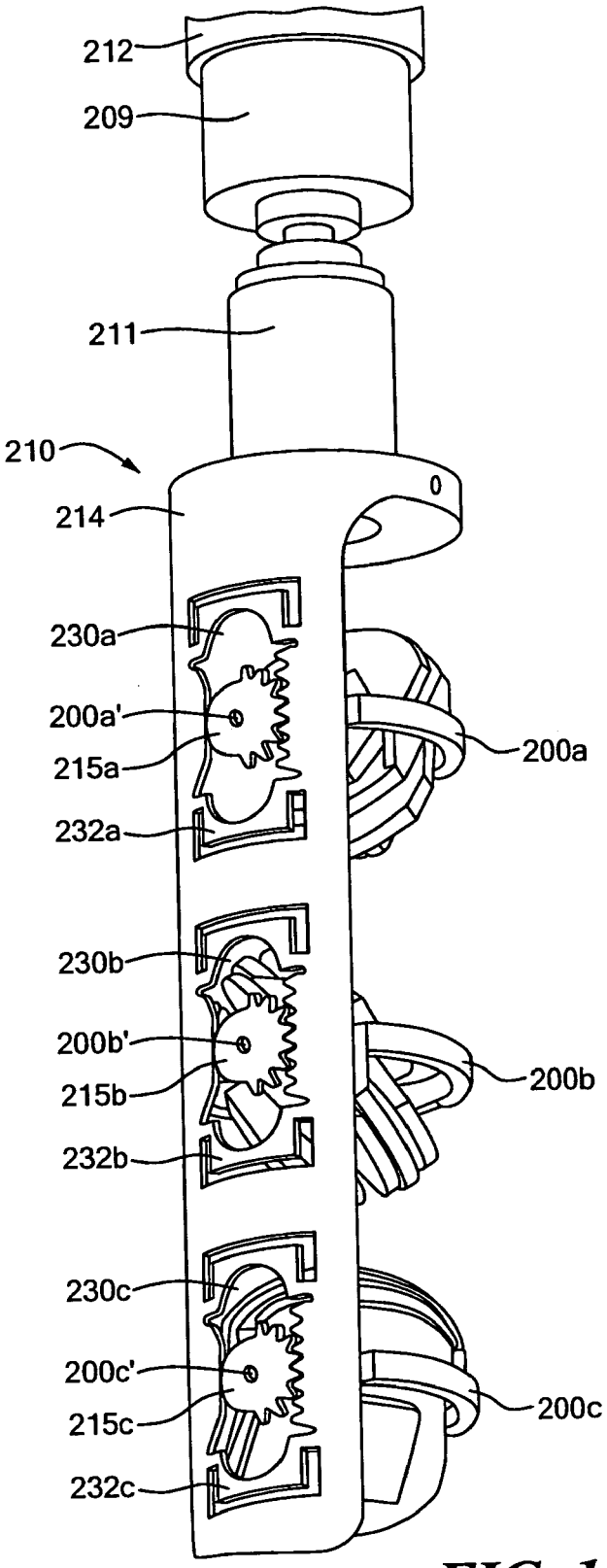
FIG. 13 is a schematic diagram of the rack and pinion gear of the borehole navigation system of FIG. 12.

Rack and pinion gear 210 includes rack 214, FIG. 13, and three pinions 215*a–c* each rotated by rack 214. Pinions 215*a–c* each engage rack 214 and are respectively connected to inner gimbal shafts 200*a'–c'*. FIG. 13 depicts pinions 215*a–c* halfway between their respective stops 230*a–c* and 232*a–c*. Inner gimbals 200*a–c* have rotary freedom while between stops 230*a–c* and 232*a–c* 180° apart. Inner gimbal motor angle readout 212 provides the gimbal angle for each of inner gimbals 200*a–c*.

Figure 13A:
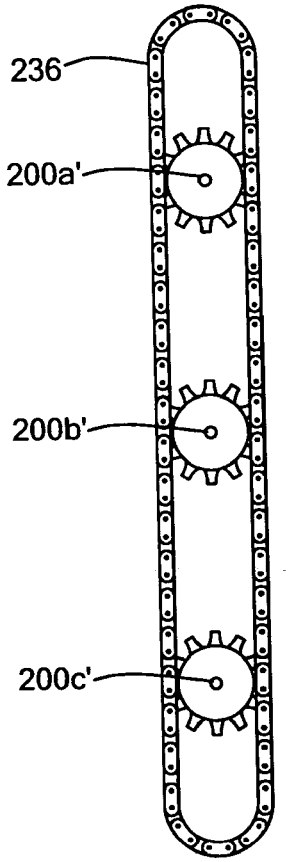
FIG. 13A is a schematic diagram of an embodiment of the borehole navigation system of FIG. 12 that uses a bicycle chain gear.

Alternatively, the inner gimbal drive system may include bicycle chain gear 236, FIG. 13A, to rotate inner gimbal shafts 200*a'*, 200*b'*, 200*c'* in parallel, or direct motor drives can be used on each inner gimbal. Misalignments from having orthogonal triads of gyros and accelerometers can be calibrated when at the inner gimbal stops. When rotating between the stops, misalignments can be calibrated using a multi-axis rotary test table, except for the non-repeatable part of the gear backlash. The non-calibrated part of the gear backlash when rotating between the stops may only occur for a short period of time, and thus may only have a small effect on navigation error.

Non-orthogonalities of inner gimbals 200*a–c* may be calibrated when the inner gimbals are at their respective stops using a topside test table. Non-orthogonalities due to gear backlash may be calibrated during the rotations between inner gimbal stops 230*a–c* and 232*a–c*, but some non-orthogonality error will remain during navigation while rotating between the stops. However, since the rotation between stops typically occurs quickly, any navigation errors while rotating between stops occur for only a short time.

Figure 14:
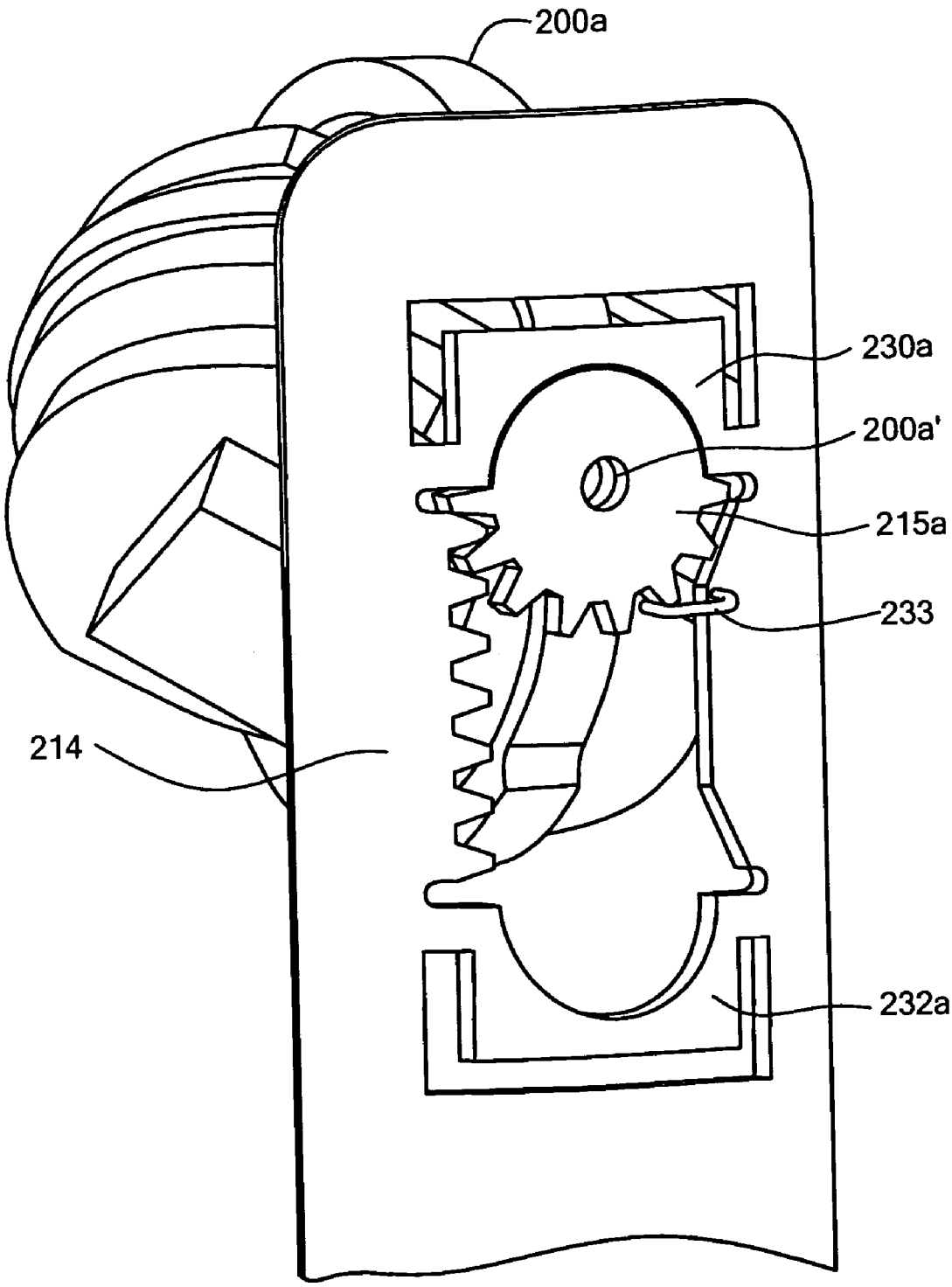
FIG. 14 is a schematic diagram of the stops of the pinion gear for an inner gimbal of the borehole navigation system of FIG. 12.

Stop 232*a*, FIGS. 13 and 14, engages pinion 215*a* and prevents it from rotating further. Each of stops 230*a–c*, 232*a–c* is made from a material that is configured to be elastic or springy such that the inner gimbal motor may force all pinions 215*a–c* into their respective stops and keep them there despite any misalignments between rack 214 and pinions 215*a–c*. Latching mechanism 233 may instead be used to keep each pinion 215 at its respective stop.

Figure 15:
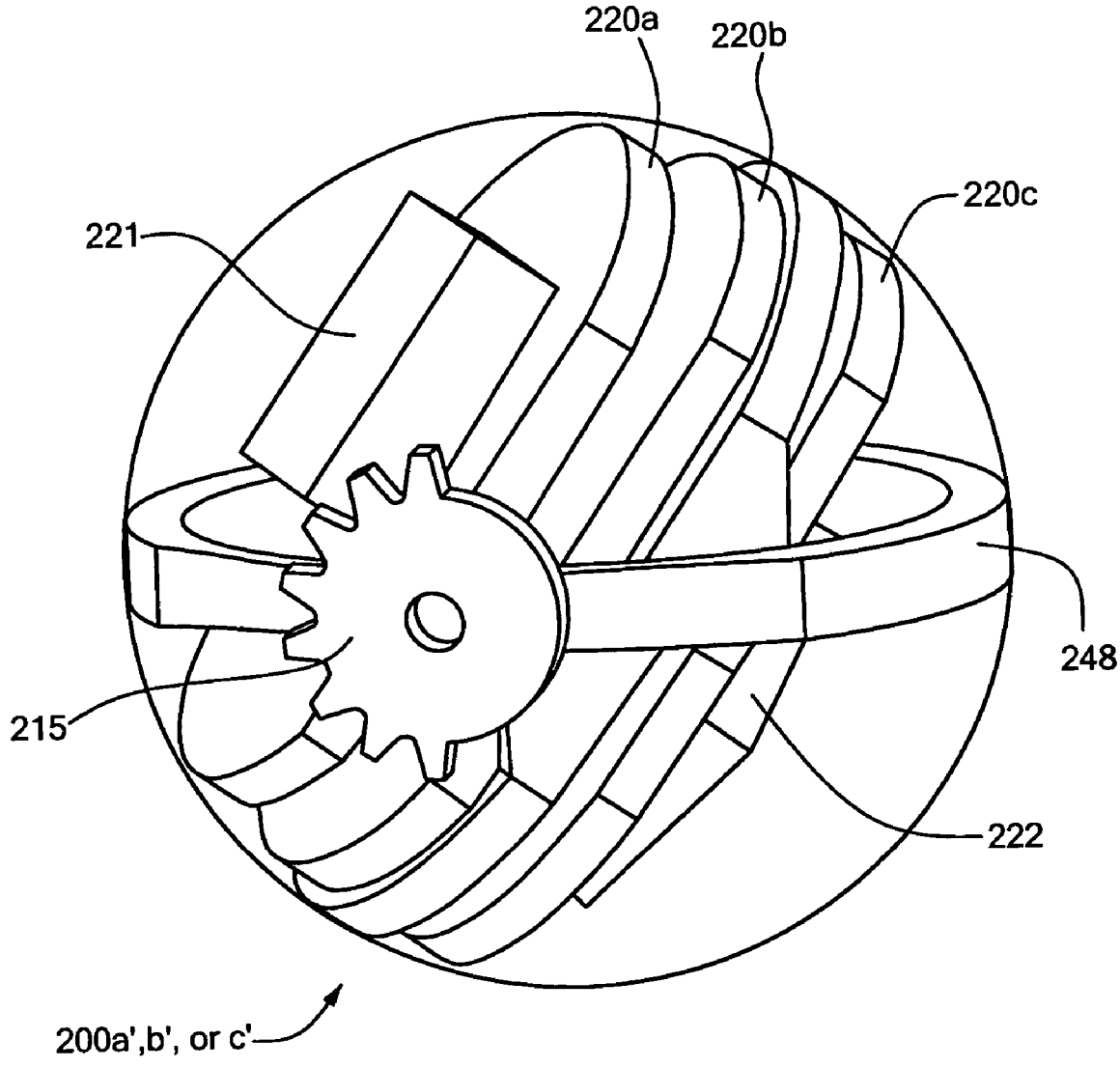
FIG. 15 is a schematic diagram of the circuit boards within each inner gimbal of FIG. 13.

Three circuit boards 220*a*, 220*b*, 220*c*, FIG. 15, are disposed within each inner gimbal 200*a*, 200*b*, or 200*c*. Circuit boards 220*a–c* are mounted in structure 248 connected to pinion 215 of each gimbal. Circuit board 220*a* includes MEMS gyro chip 221 on one side and a gyro ASIC (not shown) on the other side, where the ASIC is in close proximity to the gyro chip. The ASIC receives data from the gyro chip at approximately 5 MHz. Circuit board 220*c* includes MEMS accelerometer chip 222 on one side and an accelerometer ASIC on the other side (not shown). Middle circuit board 220*b* has a gyro gate array on one side connected to the gyro ASIC, and an accelerometer gate array on the other side connected to the accelerometer ASIC. Circuit boards 220*a–c* may include other electronic circuitry, such as for power conversion, thermal control, etc. Circuit boards 220*a–c* and sensor chips may also include temperature sensors and heaters to allow thermal control. Orthogonal triads of the sensors, which includes gyro chips 221 and accelerometer chips 222, are preferably maintained by having the normal of the sensor chip planes to be at a 54.73° angle to the inner gimbal axes, by having the intersections of the gimbal chip planes on the plane perpendicular to the inner gimbal axes be 120° apart, and by having appropriate sensor chip rotations on their circuit boards for sensor input axes that are in the chip plane. The accelerometer chips in this example have input axes perpendicular to the circuit board planks and can have arbitrary orientations on the circuit board planes, whereas the gyro chips have input axes in the circuit board plane and so have to be preferentially oriented on their circuit board planes from one inner gimbal to the next, to have the orthogonal triad orientation. Other MEMS gyro designs might have their IA perpendicular to the circuit board plane.

Data output from sensor electronics includes commands for sensor control loops, such as gyro vibration amplitude and frequency control and accelerometer force rebalance. Other data output from the sensor electronics includes the measured gyro angular rate or delta angle and accelerometer acceleration or delta velocity, which are transmitted at approximately 600 Hz or 1 kHz to gate array electronics 206, FIG. 12, outside the inner gimbals through the twist wires or couplings 213*a*, 213*b*, 213*c*, FIG. 12. The sensor electronics may also transmit temperature and other lower data rate information to gate array electronics 206.

Figure 16:
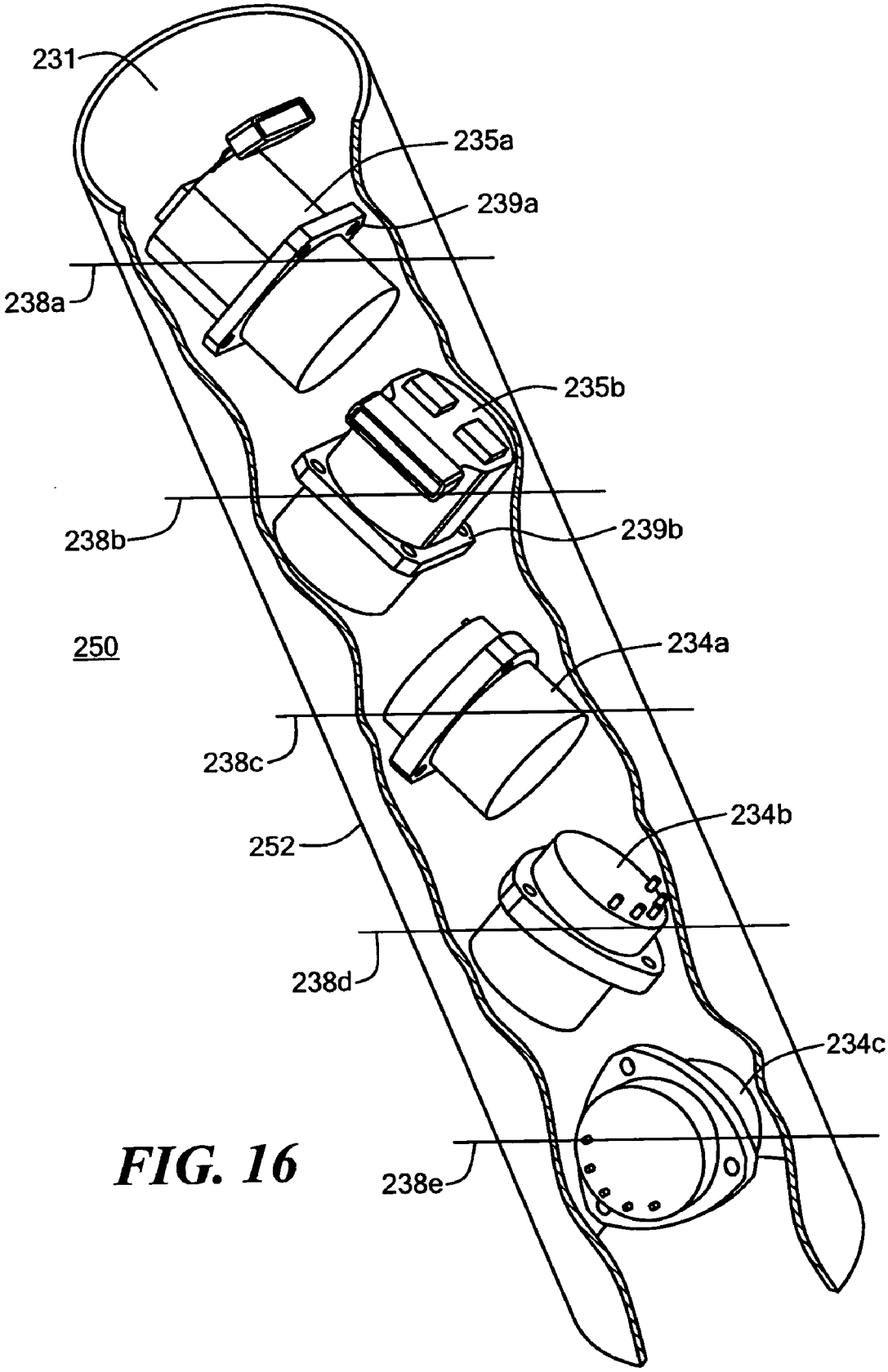
FIG. 16 is a schematic diagram of another embodiment of the borehole navigation system of FIG. 12 that includes a stack of five inner gimbals containing macro-sized gyros and accelerometers.

A stack of inner gimbals 250, FIG. 16, may also include the use of macro-sized gyros and accelerometers to provide a small diameter system for a borehole rather than or in addition to using MEMS or other solid state gyros and accelerometers. Five inner gimbals having axes 238*a*–238*e* fit within an outer gimbal assembly 252 with the inner gimbal axes being perpendicular to the outer gimbal axis 231. Two dynamically tuned two-degree-of-freedom gyros (DTG) 235*a*, 235*b* are each mounted within its own inner gimbal. The spin axis of each DTG 235*a*, 235*b* is perpendicular to DTG mounting flange 239*a*, 239*b* that is canted at an angle to its gimbal axis 238*a*, 238*b*, such that the input axes of the two DTGs in the planes of the mounting flanges form an orthogonal triad when at the inner gimbal stops or when rotating between the stops, in which one element of the triad is the combination of redundant DTG input axes. If single degree of freedom macro-sized gyros, such as fiber optic gyros, are alternatively used, three rather than two inner gimbals are preferable.

DTGs 235*a*, 235*b* are operated in torque rebalance mode, where the gyro readout angles are torqued to null and the amount of torque is the measure of input angular rate. The compensated output of the gyros, which is dependent on two independent gyro axes and the average of the two redundant gyro axes, is used to control the carousel motion of the outer gimbal and to propagate the attitude quaternion during navigation while drilling, and to compute the average gyro rates during gyrocompassing when not drilling. The other three inner gimbals include macro sized accelerometers 234*a*, 234*b*, 234*c* each oriented in its corresponding inner gimbal so that the accelerometer input axes form an orthogonal triad at the inner gimbal stops and between the stops. Alternatively, there could be one inner gimbal for an orthogonal triad of MEMS or other solid state accelerometers, or the MEMS accelerometers could fit within the macro-sized gyro gimbals.

There may be other numbers of sensors on each inner gimbal, but the combination of one MEMS gyro chip and one MEMS accelerometer chip in each of three inner gimbals is preferable. Alternatively, navigation system 188 may include six inner gimbals each having one inertial sensor located thereon or may include two inner gimbals each having three inertial sensors located thereon.

Although specific features of the invention are shown in some drawings or embodiments and not in others, this is for convenience only as each feature may be combined with any or all of the other features in accordance with the invention. The words "including", "comprising", "having", and "with"

as used herein are to be interpreted broadly and comprehensively and are not limited to any physical interconnection. Moreover, any embodiments disclosed in the subject application are not to be taken as the only possible embodiments.

Other embodiments will occur to those skilled in the art and are within the following claims:

What is claimed is:

1. An omnidirectional borehole navigation system comprising:

a housing for traversing a borehole;

an outer gimbal connected to said housing and at least two stacked inner gimbals that are connected to said outer gimbal, said inner gimbals each having an axis parallel to one another and perpendicular to an axis of the outer gimbal;

at least one inertial sensor located on each inner gimbal, the at least one inertial sensor selected from at least one gyro and at least one accelerometer, the gyros having input axes that span three dimensional space, and the accelerometers having input axes that span three dimensional space;

one or more gyro circuits within the housing and responsive to the at least one gyro to produce the inertial angular rate about each gyro input axis;

one or more accelerometer circuits within the housing and responsive to the at least one accelerometer to produce the non-gravitational acceleration along each accelerometer input axis;

a processor responsive to said gyro circuits and said accelerometer circuits for determining the attitude and the position of said housing in the borehole;

an outer gimbal drive system for controlling the orientation of the outer gimbal; and an inner gimbal drive system for controlling the orientation of each of the inner gimbals.

2. The borehole navigation system of claim 1 in which the outer gimbal has complete rotary freedom.

3. The borehole navigation system of claim 2 further including a plurality of latching mechanisms connected to the rack for keeping each pinion at its respective stop.

4. The borehole navigation system of claim 1 in which the inner gimbal drive system includes:

an inner gimbal drive motor, a rotary-to-linear gear connected to the drive motor, a rack connected to the rotary-to-linear gear and a plurality of pinions each engaging the rack, each pinion connected to an inner gimbal for maintaining the gyro input axes at substantially an orthogonal triad and the accelerometer input axes at substantially an orthogonal triad.

5. The borehole navigation system of claim 4 in which the rack includes stops that are elastic to compensate for misalignments between the rack and the pinions.

6. The borehole navigation system of claim 5 in which the inner gimbals have rotary freedom between their respective stops.

7. The borehole navigation system of claim 4 further including an inner gimbal angle readout connected to the inner gimbal drive motor.

8. The borehole navigation system of claim 1 in which the inner gimbal drive system includes a drive motor, a gear train driven-by the drive motor, each of the inner gimbals connected to the drive motor through the gear train for maintaining the gyro input axes at substantially an orthogonal triad and the accelerometer input axes at substantially an orthogonal triad.

9. The borehole navigation system of claim 8 in which the gear train includes a bicycle chain gear.

10. The borehole navigation system of claim 1 in which there are six stacked inner gimbals each having one inertial sensor located thereon.

11. The borehole navigation system of claim 1 in which there are five stacked inner gimbals, two of which each include a two-degree-of-freedom gyro and the other three each include an accelerometer.

12. The borehole navigation system of claim 1 in which there are three stacked inner gimbals, two of which each include a two-degree-of-freedom gyro and one includes three accelerometers.

13. The borehole navigation system of claim 1 in which there are three stacked inner gimbals each having two inertial sensors located thereon.

14. The borehole navigation system of claim 1 in which there are two stacked inner gimbals each having three inertial sensors located thereon.

15. The borehole navigation system of claim 1 in which there are three gyros each having an input axis, the gyro input axes substantially forming an orthogonal triad.

16. The borehole navigation system of claim 1 in which there are three accelerometers, each having an input axis, the three input axes substantially forming an orthogonal triad.

17. The borehole navigation system of claim 1 in which the gyros are MEMS gyros and the accelerometers are MEMS accelerometers.

18. The borehole navigation system of claim 17 in which there are three inner gimbals each having one MEMS gyro and one MEMS accelerometer located therein, the gyro input axes substantially forming an orthogonal triad and the accelerometer input axes substantially forming an orthogonal triad at each inner gimbal position.

19. The borehole navigation system of claim 1 in which the inner gimbals have complete rotary freedom.

20. The borehole navigation system of claim 1 further including a plurality of drive motors, one drive motor connected to each of the inner gimbals and one to the outer gimbal.

21. The borehole navigation system of claim 1 in which each inner gimbal includes a gimbal angle readout.

22. The borehole navigation system of claim 1 in which the inner gimbals are electrically coupled to the outer gimbal by a coupling selected from twist wires, twist capsules, slip rings and rotary transformers.

23. The borehole navigation system of claim 1 in which the inner gimbals are configured to communicate with the outer gimbal by a link selected from an optical communications link, an electrostatic communications link, slip rings, rotary transformers, twist wires, and twist capsules.

24. The borehole navigation system of claim 1 in which the outer gimbal is electrically coupled externally by a coupling selected from slip rings and rotary transformers.

25. The borehole navigation system of claim 1 in which the outer gimbal is configured to communicate externally by a communications link selected from an optical communications link, an electrostatic communications link, a rotary transformer, and slip rings.

26. The borehole navigation system of claim 1 in which the gyros and accelerometers are each oriented, respectively, in an orthogonal triad configuration.

27. An omnidirectional borehole navigation system comprising:

a housing for traversing a borehole;

at least one outer gimbal connected to said housing and at least two stacked inner gimbals that are nested in and connected to said outer gimbal, said inner gimbals each having an axis parallel to one another and perpendicular to an axis of the outer gimbal;

at least one inertial sensor located on each inner gimbal, the at least one inertial sensor including at least one gyro or accelerometer, the gyros having input axes that span three dimensional space and the accelerometers having input axes that span three dimensional space;

an outer gimbal drive system;

an inner gimbal drive system including an inner gimbal drive motor, a rotary-to-linear gear connected to the inner gimbal drive motor, a rack connected to the rotary-to-linear gear and a plurality of pinions each engaging the rack, each pinion connected to an inner gimbal for maintaining the gyro input axes at substantially an orthogonal triad and the accelerometer input axes at substantially an orthogonal triad;

one or more gyro circuits within the housing and responsive to the at least one gyro to produce the inertial angular rate about each gyro input axis;

one or more accelerometer circuits within the housing and responsive to the at least one accelerometer to produce the non-gravitational acceleration along each accelerometer input axis; and a processor responsive to said gyro logic circuits and said accelerometer logic circuits for determining the attitude and the position of said housing in its borehole.

28. The borehole navigation system of claim 27 in which the rack includes inner gimbal stops that are elastic to compensate for small misalignments between the pinions and the rack.

29. The borehole navigation system of claim 27 in which there are six stacked inner gimbals each having one inertial sensor located thereon.

30. The borehole navigation system of claim 27 in which there are five stacked inner gimbals, two of which each include a two-degree-of-freedom gyro and the other three each including an accelerometer.

31. The borehole navigation system of claim 27 in which there are three stacked inner gimbals, two of which each include a two-degree-of-freedom gyro and the other one including a triad of accelerometers.

32. The borehole navigation system of claim 27 in which there are three inner gimbals each having two inertial sensors located thereon.

33. The borehole navigation system of claim 27 in which there are two inner gimbals each having three inertial sensors located thereon.

34. The borehole navigation system of claim 27 in which there are three gyros each having an input axis, the three input axes substantially forming an orthogonal triad.

35. The borehole navigation system of claim 27 in which there are three accelerometers, each having an input axis, the three input axes substantially forming an orthogonal triad.

36. The borehole navigation system of claim 27 in which the gyros are MEMS gyros and the accelerometers are MEMS accelerometers.

37. The borehole navigation system of claim 36 in which there are three inner gimbals each having one MEMS gyro and one MEMS accelerometer located therein, the gyro input axes substantially forming an orthogonal triad and the accelerometer input axes substantially forming an orthogonal triad at each inner gimbal position.

38. An omnidirectional borehole navigation system comprising:

a housing for traversing a borehole;

an outer gimbal connected to said housing and at least two stacked inner gimbals that are connected to said outer gimbal, said inner gimbals each having an axis parallel to one another and perpendicular to an axis of the outer gimbal;

at least one inertial sensor located on each inner gimbal, the at least one inertial sensor selected from at least one gyro and at least one accelerometer, the gyros having input axes that span three dimensional space and the accelerometers having input axes that span three dimensional space, the borehole navigation system determining the attitude and the position of said housing in the borehole.

39. The omnidirectional borehole navigation system of claim 38 further including one or more gyro circuits within the housing and responsive to the at least one gyro to produce the inertial angular rate about each gyro input axis.

40. The omnidirectional borehole navigation system of claim 39 further including one or more accelerometer circuits within the housing and responsive to the at least one accelerometer to produce the non-gravitational acceleration along each accelerometer input axis.

41. The omnidirectional borehole navigation system of claim 40 further including a processor responsive to said gyro circuits and said accelerometer circuits for determining the attitude and the position of said housing in the borehole.

42. The omnidirectional borehole navigation system of claim 38 further including a drive system for controlling the orientation of each of the inner gimbals.

43. The omnidirectional borehole navigation system of claim 38 further including a drive system for controlling the orientation of the outer gimbal.

44. An omnidirectional borehole navigation system comprising:

a housing for traversing a borehole;

at least one outer gimbal connected to said housing and three stacked inner gimbals that are nested in and connected to said outer gimbal, said inner gimbals each having an axis parallel to one another and perpendicular to an axis of the outer gimbal;

one MEMS gyro and one MEMS accelerometer located in each inner gimbal, the gyros having input axes substantially forming an orthogonal triad and the accelerometers having input axes substantially forming an orthogonal triad at each position of the inner gimbals;

an outer gimbal drive system coupled to the at least one outer gimbal;

an inner gimbal drive system including an inner gimbal drive motor, a rotary-to-linear gear connected to the inner gimbal drive motor, a rack connected to the rotary-to-linear gear and a plurality of pinions each engaging the rack, each pinion connected to an inner gimbal for maintaining the gyro input axes at substantially an orthogonal triad and the accelerometer input axes at substantially an orthogonal triad;

one or more gyro circuits within the housing and responsive to the at least one gyro to produce the inertial angular rate about each gyro input axis;

one or more accelerometer circuits within the housing and responsive to the at least one accelerometer to produce the non-gravitational acceleration along each accelerometer input axis; and a processor responsive to said gyro logic circuits and said accelerometer logic circuits for determining the attitude and the position of said housing in its borehole.

* * * * *